US011077663B2

(12) United States Patent
Hirai et al.

(10) Patent No.: US 11,077,663 B2
(45) Date of Patent: Aug. 3, 2021

(54) HEAD MODULE

(71) Applicant: Brother Kogyo Kabushiki Kaisha, Nagoya (JP)

(72) Inventors: Keita Hirai, Nagoya (JP); Keita Sugiura, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/835,714

(22) Filed: Mar. 31, 2020

(65) Prior Publication Data

US 2020/0307197 A1 Oct. 1, 2020

(30) Foreign Application Priority Data

Apr. 1, 2019 (JP) ..... JP2019-069588
Nov. 12, 2019 (JP) ..... JP2019-204417

(51) Int. Cl.
*B41J 2/14* (2006.01)

(52) U.S. Cl.
CPC .... *B41J 2/1433* (2013.01); *B41J 2002/14419* (2013.01)

(58) Field of Classification Search
CPC ... B41J 2/14; B41J 2/1433; B41J 2002/14419
See application file for complete search history.

(56) References Cited

U.S. PATENT DOCUMENTS

2012/0160925 A1 6/2012 Hoisington et al.
2020/0101729 A1* 4/2020 Mizuno ..... B41J 2/155

FOREIGN PATENT DOCUMENTS

JP 2014-237323 A 12/2014

* cited by examiner

*Primary Examiner* — Lamson D Nguyen
(74) *Attorney, Agent, or Firm* — Banner & Witcoff, Ltd.

(57) ABSTRACT

A head module includes first individual channels each including a first nozzle orifice; a first supply manifold being in fluid communication with the first individual channels and configured to allow liquid to flow into the first individual channels therefrom; a first return manifold being in fluid communication with the first individual channels and configured to allow liquid not ejected from the first nozzle orifices to flow thereinto; second individual channels each including a second nozzle orifice; a second supply manifold being in fluid communication with the second individual channels and configured to allow liquid to flow into the second individual channels therefrom; a second return manifold being in fluid communication with the second individual channels and configured to allow liquid not ejected from the second nozzle orifices to flow thereinto; and a first bypass path providing fluid communication between the first supply manifold and the second return manifold.

16 Claims, 12 Drawing Sheets

HEAD MODULE

CROSS-REFERENCE TO RELATED APPLICATIONS

This application claims priority from Japanese Patent Application No. 2019-204417 filed on Nov. 12, 2019, which claims priority from Japanese Patent Application No. 2019-069588, filed on Apr. 1, 2019. The disclosures of these applications are incorporated herein by reference in their entirety.

TECHNICAL FIELD

Aspects of the disclosure relate to a head module that ejects liquid such as ink.

BACKGROUND

Some known head module that ejects liquid such as ink is configured to allow liquid to flow from a supply manifold (e.g., a liquid supply chamber) to a pressure chamber (e.g., a pump chamber) being in fluid communication with a nozzle orifice (e.g., a nozzle), via a supply narrowed portion (e.g., a liquid supply channel). The head module is further configured to return liquid not ejected from the nozzle orifice to a return manifold (e.g., a liquid collection chamber) via a return narrowed portion (e.g., a liquid collection channel). That is, such a head module is configured to implement nozzle circulation.

The head module is further configured to implement manifold circulation in which liquid is allowed to flow from the supply manifold (e.g., the liquid supply chamber) to the supply narrowed portion (e.g., the liquid supply channels) via a connection channel and is also allowed to flow from the connection channel to the return narrowed portion (e.g., the liquid collecting channel) via a bypass path (e.g., a bypass gap portion).

SUMMARY

In the known head module, the supply manifold and the return manifold may be in fluid communication with each other via the bypass path (e.g., the bypass gap portion). Such a configuration may thus aggravate a problem of crosstalk that may be a phenomenon in which liquid ejection from the nozzle orifice becomes instable due to effect of pressure wave propagation from the pressure chamber.

More specifically, for example, a pressure wave generated in a pressure chamber of an individual channel may propagate by two routes. The two routes may include, for example, a first route in which a pressure wave travels through a pressure chamber, a supply narrowed portion, and a supply manifold in this order and a second route in which a pressure chamber travels through a pressure chamber, a nozzle orifice, a return narrowed portion, and a return manifold in this order. The pressure wave traveling via the first route and the pressure wave traveling via the second route may be in the same phase. In a case where the supply manifold and the return manifold that are in fluid communication with the same pressure chamber are in fluid communication with each other via the bypass path, a pressure wave traveling via the first route and a pressure wave traveling via the second route may be merged via the bypass path, thereby amplifying the pressure waves. That is, in the known head module, a crosstalk phenomenon may occur.

Accordingly, aspects of the disclosure provide a head module in which effect of crosstalk caused by pressure wave propagation may be reduced.

According to one or more aspects of the disclosure, a head module may include a plurality of first individual channels, a first supply manifold, a first return manifold, a plurality of second individual channels, a second supply manifold, a second return manifold, and a first bypass path. The first individual channels may each include a first nozzle orifice. The first supply manifold may be in fluid communication with the first individual channels and configured to allow liquid to flow into the first individual channels therefrom. The first return manifold may be in fluid communication with the first individual channels and configured to allow liquid not ejected from the first nozzle orifices to flow thereinto. The second individual channels may each include a second nozzle orifice. The second supply manifold may be in fluid communication with the second individual channels and configured to allow liquid to flow into the second individual channels therefrom. The second return manifold may be in fluid communication with the second individual channels and configured to allow liquid not ejected from the second nozzle orifices to flow thereinto. The first bypass path may provide fluid communication between the first supply manifold and the second return manifold.

DETAILED DESCRIPTION

A head module according to an illustrative embodiment will be described with reference to the accompanying drawings. In the description below, the head module may be applied to a liquid ejection apparatus, for example, an ink ejection apparatus that may eject ink onto a recording sheet.

Configuration of Liquid Ejection Apparatus

Figure 1:
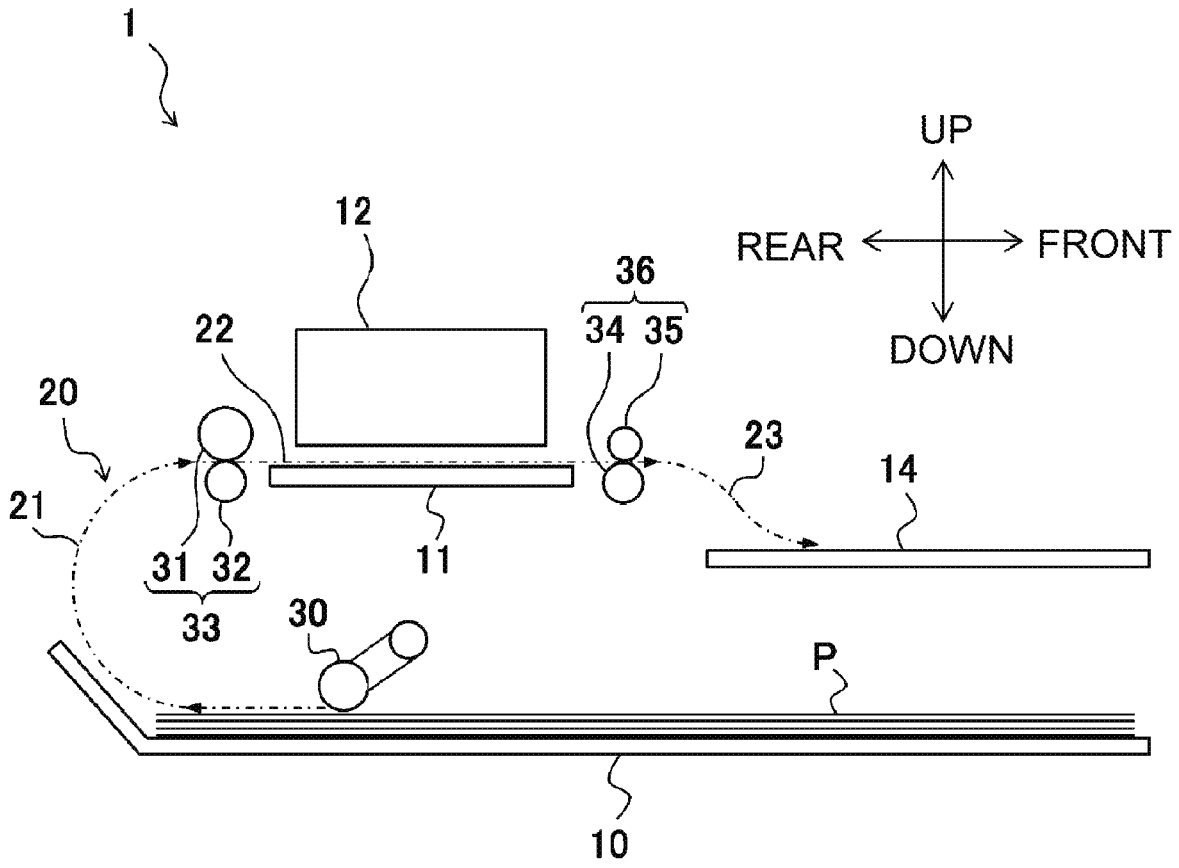
FIG. 1 is a schematic diagram illustrating a general configuration of a liquid ejection apparatus according to an illustrative embodiment of the disclosure.

As illustrated in FIG. 1, a liquid ejection apparatus 1 includes a feed tray 10, a platen 11, and a line head 12, which are disposed one above another in this order from below. The feed tray 10 is configured to store one or more recording sheets P. The platen 11 is disposed above the feed tray 10. The platen 11 has longer sides extending along a perpendicular direction that is perpendicular to a direction in which a recording sheet P is conveyed (hereinafter, referred to as the conveyance direction). The platen 11 may be a plate like member. The platen 11 is configured to support from below a recording sheet P being conveyed. The line head 12 is disposed above the platen 11. The line head 12 includes a plurality of head modules 13. The liquid ejection apparatus 1 further includes a discharge tray 14. The discharge tray 14 is disposed in front of the platen 11. The discharge tray 14 is configured to receive one or more recording sheets P having undergone printing.

The liquid ejection apparatus 1 has a sheet conveyance path 20. The sheet conveyance path 20 extends from a rear end of the feed tray 10. The sheet conveyance path 20 connects between the feed tray 10 and the discharge tray 14. The sheet conveyance path 20 includes three sections including a curved path section 21, a straight path section 22, and a last path section 23. The curved path section 21 extends curvedly upward from a rear portion of the feed tray 10 to a vicinity of a rear end of the platen 11. The straight path section 22 extends to a vicinity of a front end of the platen 11 from the end of the curved path section 21 beyond the front end of the platen 11. The last path section 23 extends to the discharge tray 14 from the end of the straight path section 22.

The liquid ejection apparatus 1 further includes a feed roller 30, a conveyance roller 31, and a discharge roller 34, which may constitute a sheet conveyor that conveys a recording sheet P. The sheet conveyor is configured to convey a recording sheet P along the sheet conveyance path 20 from the feed tray 10 to the discharge tray 14 in the conveyance direction.

More specifically, for example, the feed roller 30 is disposed directly above the feed tray 10. The feed roller 30 may contact a recording sheet P from above. The conveyance roller 31 is paired with a pinch roller 32 to constitute a conveyance roller unit 33. The conveyance roller unit 33 is disposed at a vicinity of a downstream end of the curved path section 21 in the conveyance direction. The conveyance roller unit 33 is disposed at a boundary between the curved path section 21 and the straight path section 22 and connect therebetween. The discharge roller 34 is paired with a spur roller 35 to constitute a discharge roller unit 36. The discharge roller unit 36 is disposed at a vicinity of a downstream end of the straight path section 22 in the conveyance direction. The discharge roller unit 36 is disposed at a boundary between the straight path section 22 and the last path section 23 and connect therebetween.

The feed roller 30 is configured to feed a recording sheet P to the conveyance roller unit 33 along the curved path section 21. The conveyance roller unit 33 is configured to convey a recording sheet P fed by the feed roller 30 to the discharge roller unit 36 along the straight path section 22. The head modules 13 are configured to eject ink onto a recording sheet P that is being conveyed along the platen 11 in the straight path section 22, thereby recording an image onto the recording sheet P. The discharge roller unit 36 is configured to convey a recording sheet P having undergone printing to the discharge tray 14.

Figure 2:
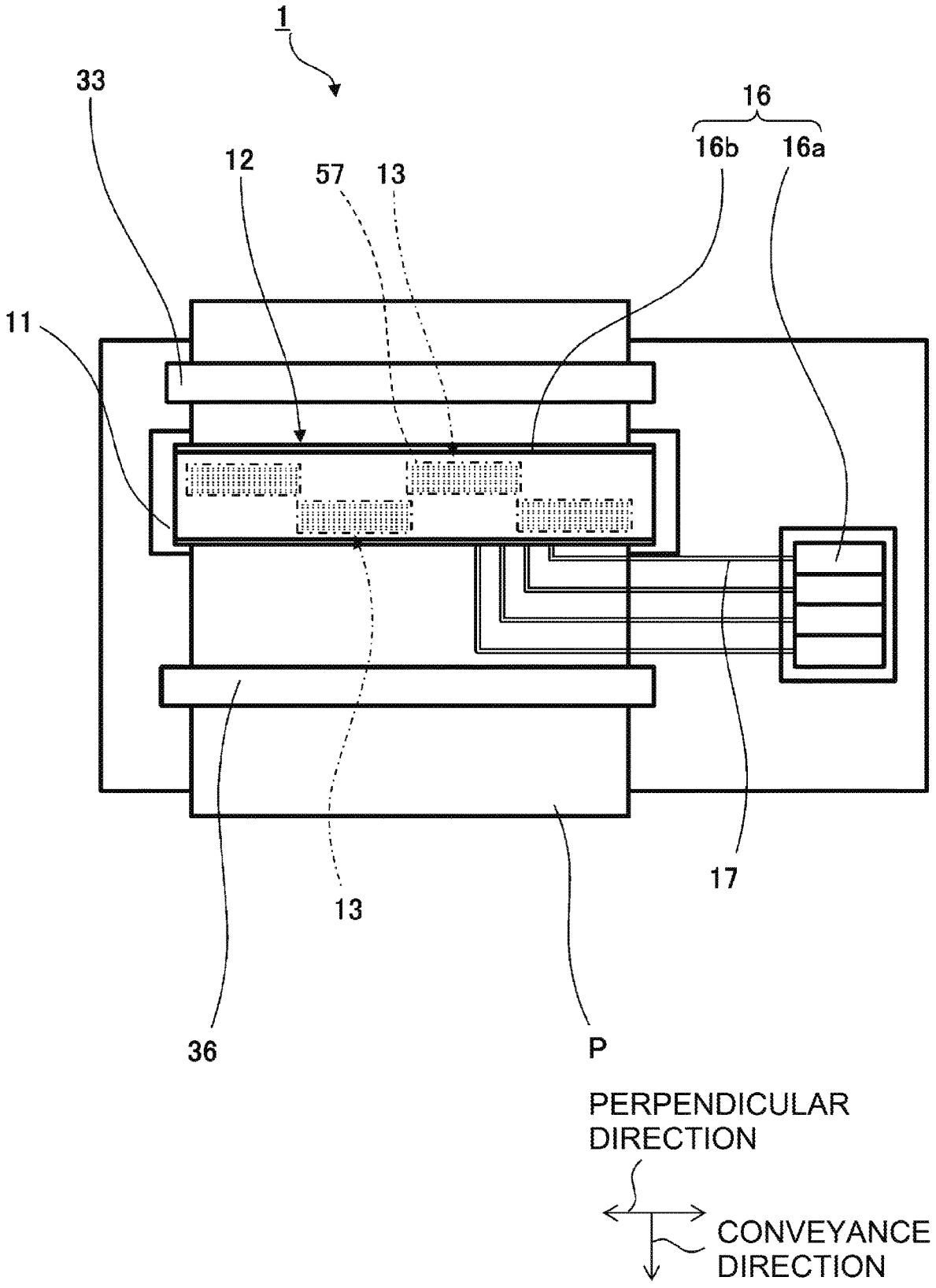
FIG. 2 is a schematic top plan view illustrating the general configuration of the liquid ejection apparatus according to the illustrative embodiment of the disclosure.

As illustrated in FIG. 2, the line head 12 has a lower surface that may face a surface of a recording sheet P. The line head 12 has a width greater than or equal to a width of a recording sheet P in the perpendicular direction perpendicular to the conveyance direction. The lower surface of the line head 12 has nozzle orifices 57 of individual channels 60*a* and 60*b* (refer to FIGS. 3A and 3B). The lower surface of the line head 12 may include a nozzle surface.

The liquid ejection apparatus 1 further includes a plurality of tanks 16. The tanks 16 are connected to corresponding nozzle orifices 57. Each tank 16 includes a sub tank 16*b* and a storage tank 16*a*. The sub tank 16*b* is disposed on the line head 12. The storage tank 16*a* is connected to the sub tank 16*b* via a tube 17. The sub tanks 16*b* and the storage tanks 16*a* each hold liquid therein. The number of tanks 16 provided corresponds to the number of colors of liquid to be ejected from the nozzle orifices 57. In the illustrative embodiment, for example, four tanks 16 are provided for four colors (e.g., black, yellow, cyan, and magenta) of liquid. Thus, the line head 12 may eject different kinds or types (e.g., colors) of liquid.

As described above, the line head 12 is fixed to a particular position and is configured to eject liquid from appropriate ones of the nozzle orifices 57. The sheet conveyor is configured to, in response to such ejection, convey a recording sheet P in the conveyance direction to record an image onto the recording sheet P.

In the illustrative embodiment, the head modules 13 constitute the line head 12. Nevertheless, in other embodiments, for example, the head modules 13 may constitute a serial head instead of the line head 12.

Configuration of Head Module

Figure 3A:
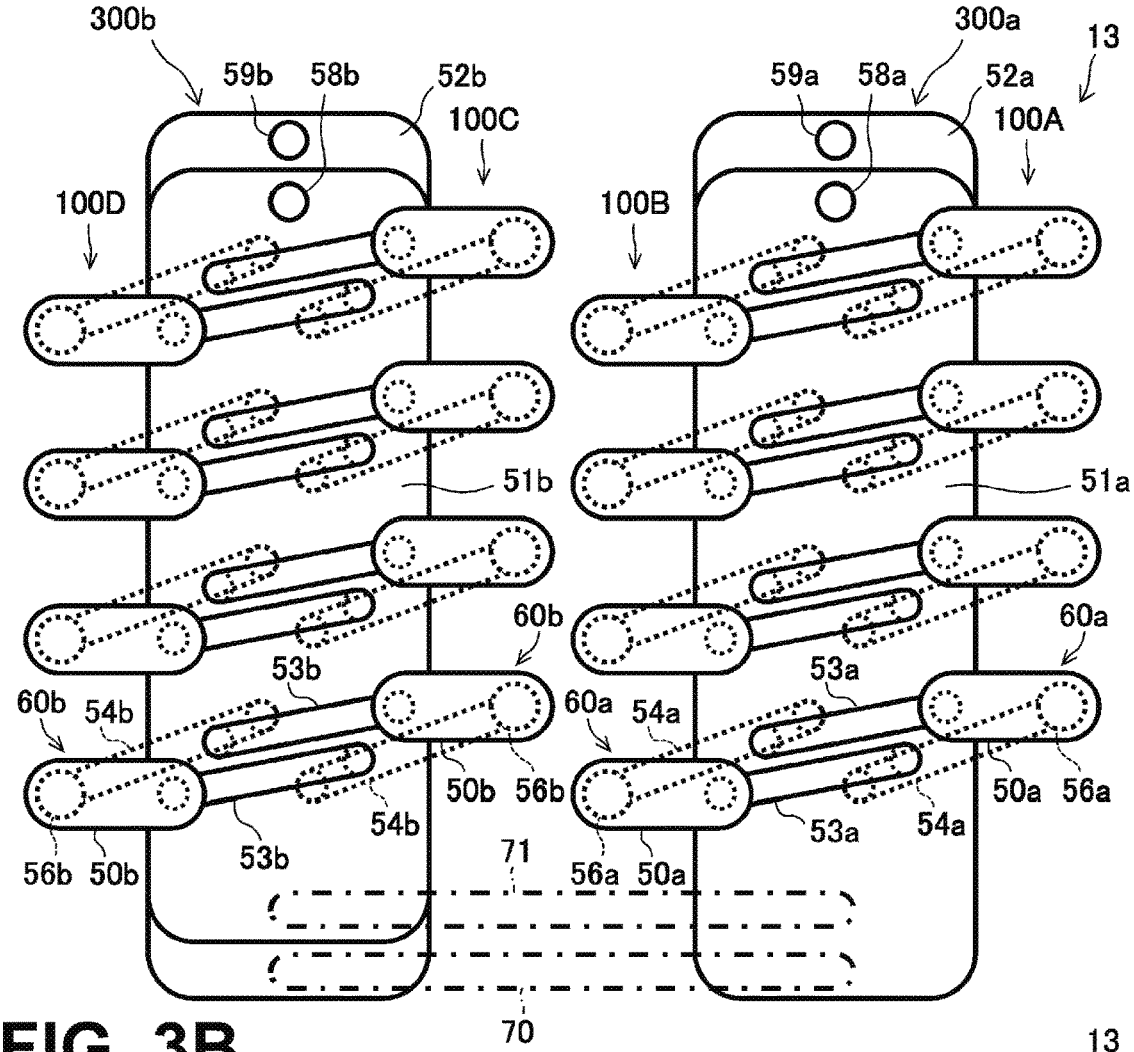
FIG. 3A is a partially enlarged schematic view of a head module of the liquid ejection apparatus of FIG. 1, illustrating a planar structure of the head module.
Figure 3B:
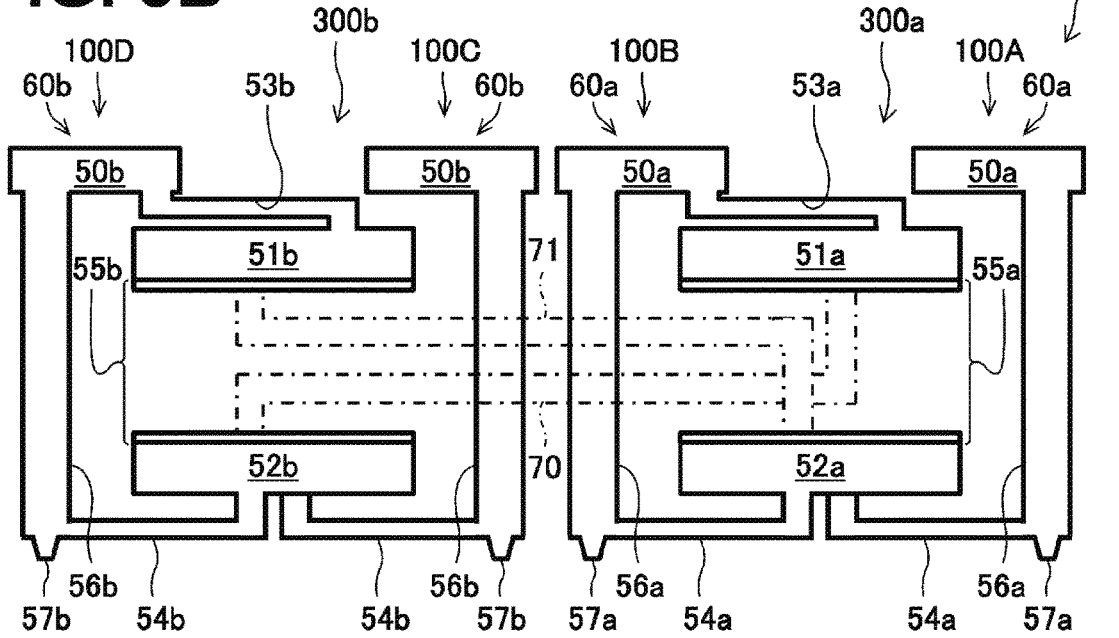
FIG. 3B is a partially enlarged schematic view of the head module of the liquid ejection apparatus of FIG. 1, illustrating a cross sectional structure of the head module.

All of the head modules 13 may have the same configuration, and therefore, one of the head modules 13 will be described in detail. Referring to FIGS. 3A and 3B, a configuration of a head module 13 will be described. The head module 13 includes a piezoelectric plate that is disposed above first pressure chambers 50*a* and second pressure chambers 50*b*. The piezoelectric plate is configured to apply pressure to liquid in the first pressure chambers 50*a* or liquid in the second pressure chambers 50*b*. For purposes of convenience, in FIGS. 3A and 3B, the piezoelectric plate is not illustrated. In FIG. 3B, for easy understanding of a positional relationship between a first bypass path 70 and a second bypass path 71, an area in which the first bypass path 70 and the second bypass path 71 are defined, that is, portions of plates in which a first damper portion 55*a* and a second damper portion 55*b* are defined, are enlarged.

In one example, the portions and channels of the head module 13 may be formed by lamination of a plurality of plates that have undergone etching (half etching) or cutting. In another example, the portions and channels of the head module 13 may be formed by lamination of a plurality of resin-made plates molded in respective particular shapes.

FIGS. 3A and 3B are partially enlarged views of the head module 13 having four different nozzle rows including a first nozzle row 100A, a second nozzle row 100B, a third nozzle row 100C, and a fourth nozzle row 100D. In the illustrative embodiment, the first nozzle row 100A and the second nozzle row 100B belong to a first island portion 300*a* including a first supply manifold 51*a* and a first return manifold 52*a*. The third nozzle row 100C and the fourth nozzle row 100D belong to a second island portion 300*b* including a second supply manifold 51*b* and a second return manifold 52*b*. In the illustrative embodiment, the first island portion 300*a* and the second island portion 300*b* may be positioned next to each other.

A supply manifold with which first individual channels 60*a* are in fluid communication may be referred to as a first supply manifold 51*a*, and a return manifold with which the first individual channels 60*a* are in fluid communication may be referred to as a first return manifold 52*a*. A supply manifold with which second individual channels 60*b* are in fluid communication may be referred to as a second supply manifold 51*b*, and a return manifold with which the second individual channels 60*b* are in fluid communication may be referred to as a second return manifold 52*b*. An island portion may be a unit including a supply manifold and a return manifold each overlapping corresponding pressure chambers of respective particular individual channels when viewed in plan from the nozzle surface.

Individual channels constituting the first nozzle row 100A belonging to the first island portion 300*a* and individual channels constituting the second nozzle row 100B belonging to the first island portion 300*a* may have the same configuration, and therefore, those individual channels will be referred to as the first individual channels 60*a* without distinguishing therebetween. Hereinafter, the description will be thus provided with respect to one of the first individual channels 60*a*. Individual channels constituting the third nozzle row 100C belonging to the second island portion 300*b* and individual channels constituting the fourth nozzle row 100D belonging to the second island portion 300*b* may have the same configuration, and therefore, those individual channels will be referred to as the second individual channels 60*b* without distinguishing therebetween. Hereinafter, the description will be thus provided with respect to one of the second individual channels 60*b*.

A first individual channel 60*a* includes a first pressure chamber 50*a*, a first descender 56*a*, and a first nozzle orifice 57*a*. The first descender 56*a* is in fluid communication with the first pressure chamber 50*a*. The first nozzle orifice 57*a* is in fluid communication with the first descender 56*a* and is configured to allow a liquid droplet to be ejected therefrom. A direction toward which the surface of the head module 13 that has the first nozzle orifice 57*a* (i.e., the nozzle surface) faces may be defined as a down direction, and a direction opposite to the down direction may be defined as an up direction. With respect to the defined directions, the first pressure chamber 50*a* is disposed above the first descender 56*a*. The piezoelectric plate (e.g., a piezoelectric body) is disposed above the first pressure chambers 50*a*. The piezoelectric plate is configured to apply pressure to liquid in appropriate ones of the first pressure chambers 50*a* at a certain timing. More specifically, for example, in response to application of a voltage to the piezoelectric plate at a certain timing, a volume of the piezoelectric plate changes to apply pressure to liquid in appropriate ones of the first pressure chambers 50*a*, thereby enabling the head module 13 to eject a liquid droplet from one or more first nozzle orifices 57*a*.

The first individual channel 60*a* includes a first supply narrowed portion 53*a*. The first individual channel 60*a* is in fluid communication with the first supply manifold 51*a* via the first supply narrowed portion 53*a*. The first individual channel 60*a* further includes a first return narrowed portion 54*a*. The first individual channel 60*a* is in fluid communication with the first return manifold 52*a* via the first return narrowed portion 54*a*. More specifically, for example, the first supply manifold 51*a* and the first pressure chamber 50*a* of the first individual channel 60*a* are in fluid communication with each other via the first supply narrowed portion 53*a* whose flow path diameter is narrowed. The first nozzle orifice 57*a* of the first individual channel 60*a* and the first return manifold 52*a* are in fluid communication with each other via the first return narrowed portion 54*a* whose flow path diameter is narrowed.

In the liquid ejection apparatus 1, liquid is supplied from a corresponding tank 16 to flow into the first supply manifold 51*a* via a first inlet 58*a*. Liquid is then supplied to the first pressure chamber 50*a* of the first individual channel 60*a* via the first supply narrowed portion 53*a*. In response to application of pressure to liquid in the first pressure chamber 50*a*, liquid is led to the first nozzle orifice 57*a* through the first descender 56*a*, thereby being ejected from the first nozzle orifice 57*a* in a droplet form. Liquid not ejected from the first nozzle orifice 57*a* is caused to flow to the first return manifold 52*a* via a first return narrowed portion 54*a*. Liquid in the first return manifold 52*a* is then returned to the corresponding tank 16 via a first outlet 59*a*. As described above, nozzle circulation may be implemented with respect to the first individual channel 60*a*. Such nozzle circulation may be implemented with each first individual channel 60*a* belonging to the first island portion 300*a*.

The first supply manifold 51*a* is at a positive pressure for allowing liquid to flow into the first pressure chamber 50*a*. The first return manifold 52*a* is at a negative pressure for allowing liquid not ejected from the first nozzle orifice 57*a* to flow thereinto.

The first supply manifold 51*a* and the first return manifold 52*a* overlap each other when viewed in plan from the nozzle surface. As described above, the direction toward which the nozzle surface of the head module 13 faces may be defined as the down direction, and the direction opposite to the down direction may be defined as the up direction. With reference to the defined directions, the first supply manifold 51*a* is disposed above the first return manifold 52*a*. The head module 13 further includes a first damper portion 55*a* between the first supply manifold 51*a* and the first return manifold 52*a*. The first damper portion 55*a* is configured to reduce effect of a pressure wave propagating to the first supply manifold 51*a* from the first pressure chamber 50*a* via the first supply narrowed portion 53*a*. The first damper portion 55*a* is further configured to reduce effect of a pressure wave propagating to the first return manifold 52*a* from the first pressure chamber 50*a* via a first return narrowed portion 54*a*.

Each of the second individual channels 60*b* may have the same configuration as the first individual channel 60*a* and therefore one of the second individual channels 60*b* will be representatively briefly described. A second individual channel 60*b* includes a second pressure chamber 50*b*, a second descender 56*b*, and a second nozzle orifice 57*b*. The second descender 56*b* is in fluid communication with the second pressure chamber 50*b*. The second nozzle orifice 57*b* is in fluid communication with the second descender 56*b* and is configured to allow a liquid droplet to be ejected therefrom. The second individual channel 60*b* is connected to the second supply manifold 51*b* via a corresponding second return narrowed portion 54*b* and is also connected to the second return manifold 52*b* via a corresponding second return narrowed portion 54*b*.

When viewed in plan from the nozzle surface, the second supply manifold 51*b* and the second return manifold 52*b* overlap each other. The head module 13 further includes a second damper portion 55*b* between the second supply manifold 51*b* and the second return manifold 52*b*. In the illustrative embodiment, the first damper portion 55*a* and the second damper portion 55*b* are defined by a plurality of, for example, two plates such as a first damper plate 80 and a second damper plate 81 having hollow portions for defining damper spaces.

Figure 4:
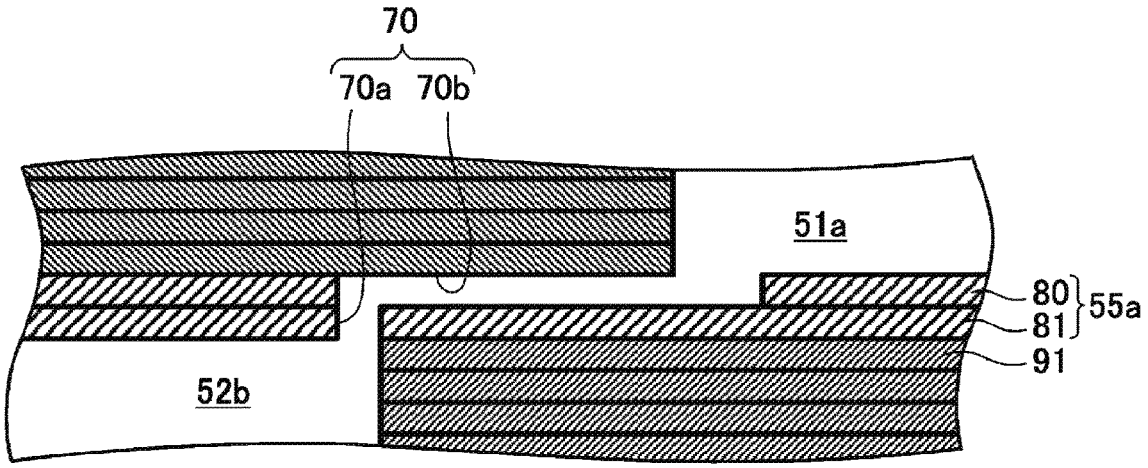
FIG. 4 is a sectional view illustrating a configuration of a first bypass path of the head module according to the illustrative embodiment of the disclosure.

Although the first individual channel 60*a* and the second individual channel 60*b* belong to respective different island portions, the first individual channel 60*a* and the second individual channel 60*b* are connected to each other by a liquid circulation path that may be the first bypass path 70. More specifically, for example, as illustrated in FIG. 3B, the first supply manifold 51*a* and the second return manifold 52*b* are connected to each other via the first bypass path 70, thereby allowing some liquid in the first supply manifold 51*a* to flow into the second return manifold 52*b*. Such a configuration may thus enable liquid to circulate between the first supply manifold 51*a* and the second return manifold 52*b* (hereinafter, such liquid circulation may be referred to as the "manifold circulation"). Referring to FIG. 4, a configuration of the first bypass path 70 will be described.

As illustrated in FIG. 4, in the illustrative embodiment, the first bypass path 70 may be defined by the first damper plate 80 and the second damper plate 81 that define the first damper portion 55*a* and the second damper portion 55*b*. The first damper plate 80 and the second damper plate 81 may serve as walls defining the first supply manifold 51*a* and the second return manifold 52*b*. The first damper plate 80 may define a bottom surface of the first supply manifold 51*a*. The second damper plate 81 may define an upper surface of the second return manifold 52*b*.

More specifically, for example, the first damper plate 80 further has a first flow path 70*b* that may be a cutaway portion defined in a particular area other than the area having the first damper portion 55*a* and the second damper portion 55*b*. The first flow path 70*b* is in fluid communication with the first supply manifold 51*a*.

The second damper plate 81 further has a first bypass hole 70*a* that may be a through hole defined in a particular area other than the area having the first damper portion 55*a* and the second damper portion 55*b*. The first bypass hole 70*a* penetrates the second damper plate 81 in an up-down direction (e.g., a plate laminating direction). The first bypass hole 70*a* has one opening end and the other opening end. The first bypass hole 70*a* is in fluid communication with the second return manifold 52*b* via the one opening end and in fluid communication with the first flow path 70*b* via the other opening end. When viewed in plan from the nozzle surface, the first flow path 70*b* is positioned overlapping the first supply manifold 51*a* and the first bypass hole 70*a*.

In one example, the first bypass path 70 may be defined by lamination of the first damper plate 80 and the second damper plate 81, each of which has undergone etching or cutting. In another example, the first bypass path 70 may be defined by lamination of the first damper plate 80 and the second damper plate 81, each of which may be a resin molded plate having a particular shape. Pressure to be applied to liquid flowing through the first bypass path 70 may be easily controlled by changing the shapes and sizes of the first bypass hole 70*a* and the first flow path 70*b* as appropriate. In one example, the first flow path 70*b* may be a narrow groove or slit extending from the first supply manifold 51*a* toward the second return manifold 52*b* in the first damper plate 80. In another example, when viewed in plan from the nozzle surface, the first flow path 70*b* may be a through hole. The through hole may have a diameter size enough to overlap each of the first supply manifold 51*a* and the first bypass hole 70*a* and penetrate the first damper plate 80 in the up-down direction.

In the head module 13, the second supply manifold 51*b* and the first return manifold 52*a* are in fluid communication with each other via the second bypass path 71, thereby allowing some liquid in the second supply manifold 51*b* to flow into the first return manifold 52*a*. Such a configuration may thus enable liquid to circulate between the second supply manifold 51*b* and the first return manifold 52*a* (i.e., the manifold circulation).

Figure 5:
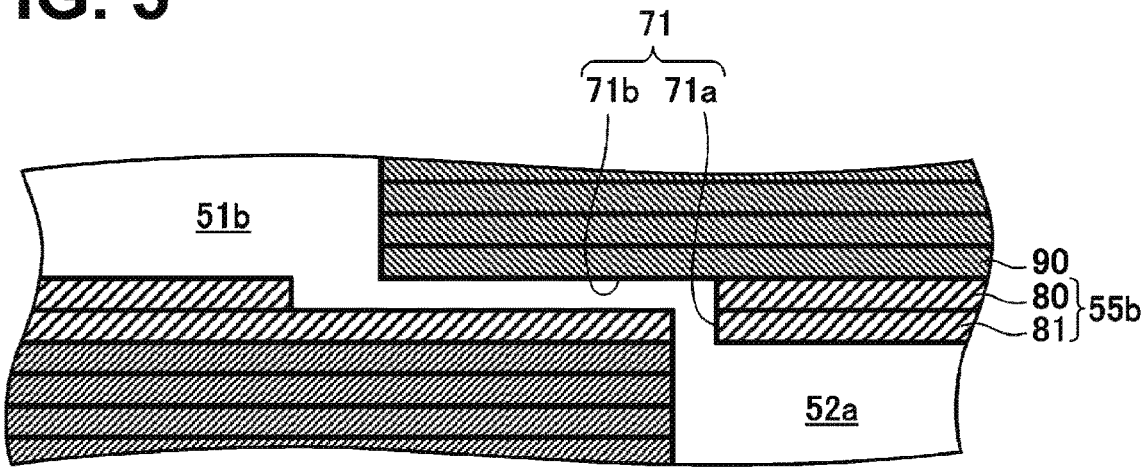
FIG. 5 is a sectional view illustrating a configuration of a second bypass path of the head module according to the illustrative embodiment of the disclosure.

Referring to FIG. 5, a configuration of the second bypass path 71 will be described.

As illustrated in FIG. 5, in the illustrative embodiment, the second bypass path 71 may be defined by the first damper plate 80 and the second damper plate 81 that define the first damper portion 55*a* and the second damper portion 55*b*. The first damper plate 80 and the second damper plate 81 may also serve as walls defining the second supply manifold 51*b* and the first return manifold 52*a*. The first damper plate 80 may define a bottom surface of the second supply manifold 51*b*. The second damper plate 81 may define an upper surface of the first return manifold 52*a*.

More specifically, for example, the first damper plate 80 further has a second flow path 71*b* that may be a cutaway portion defined in a particular area other than the area having the first damper portion 55*a*, the second damper portion 55*b*, and the first bypass path 70. The second flow path 71*b* is in fluid communication with the second supply manifold 51*b*.

The second damper plate 81 further has a second bypass hole 71*a* that may be a through hole defined in a particular area other than the area having the first damper portion 55*a*, the second damper portion 55*b*, and the first bypass path 70. The second bypass hole 71*a* penetrates the second damper plate 81 in the up-down direction (e.g., the plate laminating direction). The second bypass hole 71*a* has one opening end and the other opening end. The second bypass hole 71*a* is in fluid communication with the first return manifold 52*a* via the one opening end and in fluid communication with the second flow path 71*b* via the other opening end. When viewed in plan from the nozzle surface, the second flow path 71*b* is positioned overlapping the second supply manifold 51*b* and the second bypass hole 71*a*.

In a similar manner to the first bypass path 70, in one example, the second bypass path 71 may be defined by lamination of the first damper plate 80 and the second damper plate 81, each of which has undergone etching or cutting. In another example, the second bypass path 71 may be formed by lamination of the first damper plate 80 and the second damper plate 81, each of which may be a resin molded plate having a particular shape. Pressure to be applied to liquid flowing through the second bypass path 71 may be easily controlled by changing the shapes and sizes of the second bypass hole 71*a* and the second flow path 71*b* as appropriate. In one example, the second flow path 71*b* may be a narrow groove or slit extending from the second supply manifold 51*b* toward the first return manifold 52*a* in the first damper plate 80. In another example, when viewed in plan from the nozzle surface, the second flow path 71*b* may be a through hole. The through hole may have a diameter size enough to overlap each of the second supply manifold 51*b* and the second bypass hole 71*a* and penetrate the first damper plate 80 in the up-down direction.

As described above, in the head module 13 according to the illustrative embodiment, a supply manifold and a return manifold that belong to respective different island portions are in fluid communication with each other to allow to implement the manifold circulation therebetween. Such a configuration may thus prevent a pressure wave propagating from the first pressure chamber 50*a* through the first supply manifold 51*a* and another pressure wave propagating from the first pressure chamber 50*a* through the first return manifold 52*a* from merging each other via the bypass path (e.g., the first bypass path 70 or the second bypass path 71), thereby reducing effect of crosstalk. Such a configuration may also a pressure wave propagating from the second pressure chamber 50*b* through the second supply manifold 51*b* and another pressure wave propagating from the second pressure chamber 50*b* through the second return manifold 52*b* from merging each other via the bypass path (e.g., the first bypass path 70 or the second bypass path 71), thereby reducing effect of crosstalk.

Nevertheless, the configuration of the head module 13 according to the illustrative embodiment may allow a pressure wave propagating from the first pressure chamber 50*a* through the first supply manifold 51*a* and another pressure wave propagating from the second pressure chamber 50*b* through the second return manifold 52*b* to merge each other via the first bypass path 70. Further, the configuration of the head module 13 according to the illustrative embodiment may allow a pressure wave propagating from the second pressure chamber 50*b* through the second supply manifold 51*b* and another pressure wave propagating from the first pressure chamber 50*a* through the first return manifold 52*a* to merge each other via the second bypass path 71.

As described above, however, the first individual channel 60*a* and the second individual channel 60*b* belong to respective different island portions. That is, the first individual channel 60*a* is included in one nozzle row (e.g., the first nozzle row 100A or the second nozzle row 100B) and the second individual channel 60*b* is included in another nozzle row (e.g., the third nozzle rows 100C and the fourth nozzle rows 100D). Thus, a possibility that the first individual channel 60*a* ejects a liquid droplet at the same timing as the second individual channel 60*b* ejects a liquid droplet may be less than a possibility that individual channels included in the same nozzle row eject liquid droplets, respectively, at the same timing.

Consequently, a possibility that a pressure wave propagating through the first supply manifold 51*a* is in the same phase as a pressure wave propagating through the second return manifold 52*b* may be reduced, thereby being less susceptible to effect of crosstalk even if the pressure waves merge with each other. In addition, a possibility that a pressure wave propagating through the second supply manifold 51*b* is in the same phase as a pressure wave propagating through the first return manifold 52*a* may be reduced, thereby being less susceptible to effect of crosstalk even if the pressure waves merge with each other.

As described above, the first bypass path 70 and the second bypass path 71 are both defined in the first damper plate 80 and in the second damper plate 81. Thus, the first bypass path 70 and the second bypass path 71 may need to be laid out as appropriate. Further, based on the layout of the first bypass path 70 and the second bypass path 71, the first supply manifold 51*a*, the first return manifold 52*a*, the second supply manifold 51*b*, and the second return manifold 52*b* may also need to be laid out as appropriate.

Figure 6:
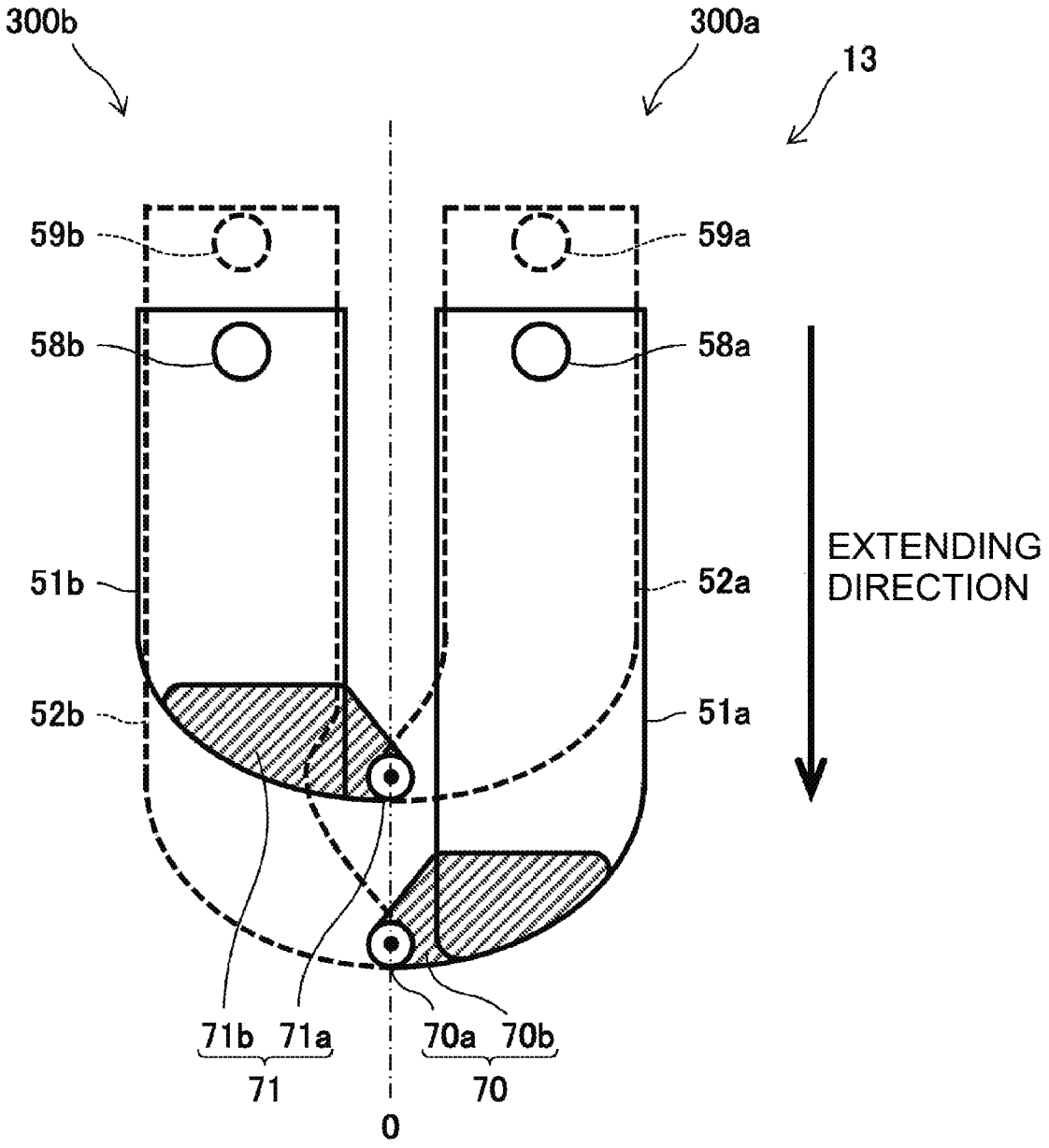
FIG. 6 is a partially enlarged schematic plan view of the head module according to the illustrative embodiment, illustrating a positional relationship between a first supply manifold and a first return manifold, between a second supply manifold and a second return manifold, and between the first bypass path and the second bypass path.

Referring to FIG. 6, a description will be provided on a positional relationship between the first supply manifold 51*a* and the first return manifold 52*a* both included in the first island portion 300*a*, between the second supply manifold 51*b* and the second return manifold 52*b* both included in the second island portion 300*b*, and between the first bypass path 70 and the second bypass path 71. In FIG. 6, the first supply manifold 51*a* and the second supply manifold 51*b* are indicated by a solid line, and the first return manifold 52*a* and the second return manifold 52*b* are indicated by a dashed line. In FIG. 6, the first individual channels 60*a* and the second individual channels 60*b* are not illustrated.

As illustrated in FIG. 6, in the head module 13 of the liquid ejection apparatus 1, when viewed in plan from the nozzle surface, the first supply manifold 51*a* and the first return manifold 52*a* overlap each other and extend in the same extending direction. Nevertheless, the first supply manifold 51*a* and the first return manifold 52*a* have respective different lengths in the extending direction. When viewed in plan from the nozzle surface, the second supply manifold 51*b* and the second return manifold 52*b* overlap each other and extend in the same extending direction. Nevertheless, the second supply manifold 51*b* and the second return manifold 52*b* have respective different lengths in the extending direction.

The first supply manifold 51*a* and the second return manifold 52*b* each have a front end portion and a base end portion opposite to the front end portion in the extending direction. The front end portion of the first supply manifold 51*a* is positioned at substantially the same position as the front end portion of the second return manifold 52*b*. The first bypass path 70 thus connects between the front end portion of the first supply manifold 51*a* and the front end portion of the second return manifold 52*b*. The first supply manifold 51*a* has a first inlet 58*a* at the base end portion thereof. The second return manifold 52*b* has a second outlet 59*b* at the base end portion thereof.

The second supply manifold 51*b* and the first return manifold 52*a* each have a front end portion and a base end portion opposite to the front end portion in the extending direction. The front end portion of the second supply manifold 51*b* is positioned at substantially the same position as the front end portion of the first return manifold 52*a*. The second bypass path 71 thus connects between the front end portion of the second supply manifold 51*b* and the front end portion of the first return manifold 52*a*. The second supply manifold 51*b* has a second inlet 58*b* at the base end portion. The first return manifold 52*a* has a first outlet 59*a* at the base end portion.

The first bypass path 70 is farther from the first outlet 59*a* than the second bypass path 71 is from the first outlet 59*a* in the extending direction. Such an arrangement may enable the first bypass path 70 and the second bypass path 71 not to overlap each other.

Figure 7:
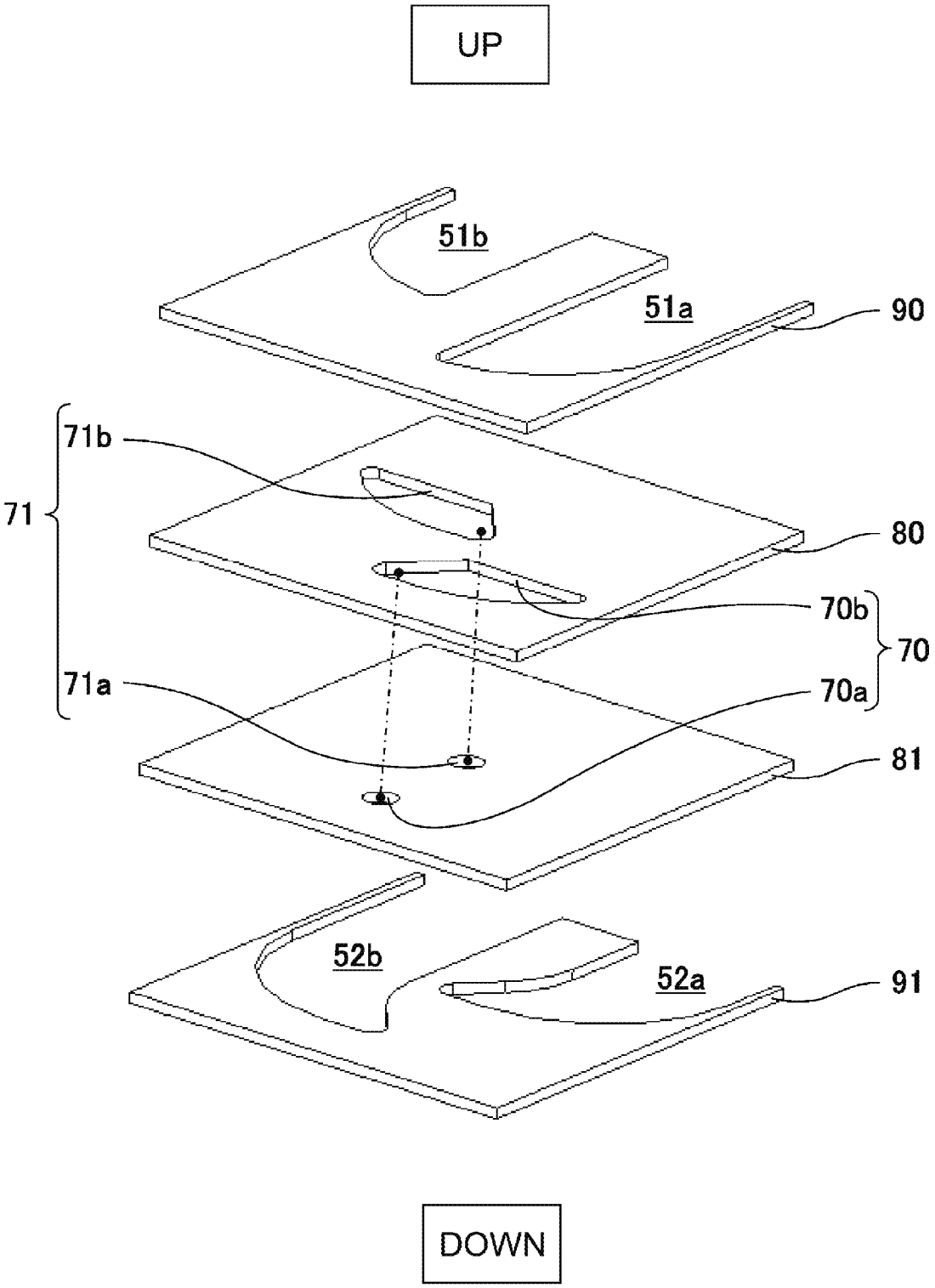
FIG. 7 is a disassembled perspective view of the head module including plates defining the first bypass path and the second bypass path according to the illustrative embodiment of the disclosure.

Referring to FIG. 7, the first bypass path 70 and the second bypass path 71 will be described in detail.

As illustrated in FIG. 7, a plate 90 and the first damper plate 80 are laminated one above the other. The first damper plate 80 may thus define the bottom surface of the first supply manifold 51*a* and the bottom surface of the second supply manifold 51*b*. The plate 90 has a cutaway portion having a shape corresponding to the first supply manifold 51*a*. The first damper plate 80 has a cutaway portion serving as the first flow path 70*b*. The first supply manifold 51*a* and the first bypass path 70 are in fluid communication with each other in an overlapping area of the cutaway portion of the plate 90 and the cutaway portion of the first damper plate 80. The plate 90 has another cutaway portion having a shape corresponding to the second supply manifold 51*b*. The first damper plate 80 has another cutaway portion serving as the second flow path 71*b*. The second supply manifold 51*b* and the second bypass path 71 are in fluid communication with each other in an overlapping area of the cutaway portion of the plate 90 and the cutaway portion of the first damper plate 80.

As illustrated in FIG. 7, the second damper plate 81 and a plate 91 are laminated one above the other. The second damper plate 81 may thus define the upper surface of the first return manifold 52*a* and the upper surface of the second return manifold 52*b*. The plate 91 has a cutaway portion having a shape corresponding to the first return manifold 52*a*. The second damper plate 81 has a cutaway portion serving as the second bypass hole 71*a*. The first return manifold 52*a* and the second bypass path 71 are in fluid communication with each other in an overlapping area of the cutaway portion of the plate 91 and the cutaway portion of the second damper plate 81. The plate 91 has another cutaway portion having a shape corresponding to the second return manifold 52*b*. The second damper plate 81 has another cutaway portion serving as the first bypass hole 70*a*. The second return manifold 52*b* and the first bypass path 70 are in fluid communication with each other in an overlapping area of the cutaway portion of the plate 91 and the cutaway portion of the second damper plate 81.

The first damper plate 80 has sector-shaped holes each having an arc curved correspondingly to the front end portion of a corresponding one of the first supply manifold 51*a* and the second supply manifold 51*b*. The first flow path 70*b* and the second flow path 71*b* each having a sector shape are defined by lamination of the plate 90, the first damper plate 80, and the second damper plate 81.

The first flow path 70*b* is positioned such that an end portion of the arc of the first flow path 70*b* closer to the second island portion 300*b* overlaps the first bypass hole 70*a* of the second damper plate 81.

Such a configuration may allow liquid held in the first supply manifold 51*a* to flow into the first flow path 70*b* having an opening larger than the first bypass hole 70*a*. Liquid is then allowed to further flow toward the end portion of the arc of the first flow path 70*b* overlapping the first bypass hole 70*a*. A width of the first flow path 70*b* gradually decreases toward the end portion of the arc having the first bypass hole 70*a*. With this configuration, after liquid flows into the first flow path 70*b*, pressure applied to liquid flowing in the first flow path 70*b* is controlled before liquid reaches the first bypass hole 70*a*, and then liquid flows into the second return manifold 52*b* via the first bypass hole 70*a*.

The second flow path 71*b* is positioned such that an end portion of the arc of the second flow path 71*b* closer to the first island portion 300*a* overlaps the second bypass hole 71*a* of the second damper plate 81.

Such a configuration may allow liquid held in the second supply manifold 51*b* to flow into the second flow path 71*b* having an opening larger than the second bypass hole 71*a*. Liquid is then allowed to further flow toward the end portion of the arc of the second flow path 71*b* overlapping the second bypass hole 71*a*. In a similar manner to the first flow path 70*b*, a width of the second flow path 71*b* gradually decreases toward the end portion of the arc having the second bypass hole 71*a*. With this configuration, after liquid flows into the second flow path 71*b*, pressure applied to liquid flowing in the second flow path 71*b* is controlled before liquid reaches the second bypass hole 71*a*, and then liquid flows into the first return manifold 52*a* via the second bypass hole 71*a*.

As illustrated in FIG. 6, when viewed in plan from the nozzle surface, the center of the first bypass hole 70*a* of the first bypass path 70 is on the center line O between and parallel to the first supply manifold 51*a* and the second return manifold 52*b*. When viewed in plan from the nozzle surface, the center of the second bypass hole 71*a* of the second bypass path 71 is on the center line O extending between and parallel to the second supply manifold 51*b* and the first return manifold 52*a*. With this configuration, when viewed in plan from the nozzle surface, a combined shape of the first supply manifold 51*a* and the first flow path 70*b* of the first bypass path 70 and the shape of the second return manifold 52*b* are substantially symmetric with respect to the center line O. Further, when viewed in plan from the nozzle surface, a combined shape of the second supply manifold 51*b* and the second flow path 71*b* of the second bypass path 71 and the shape of the first return manifold 52*a* are substantially symmetric with respect to the center line O. Such a configuration may enable a smooth connection of the manifolds belonging to the respective different island portions.

As illustrated in FIG. 6, in the head module 13 according to the illustrative embodiment, the first supply manifold 51*a* and the second supply manifold 51*b* have the first inlet 58*a* and the second inlet 58*b*, respectively, at their base end portions opposite to the front end portions thereof having the first bypass path 70 and the second bypass path 71, respectively, in the extending direction. Further, the first return manifold 52*a* and the second return manifold 52*b* have the first outlet 59*a* and the second outlet 59*b*, respectively, at the base end portions opposite to the front end portions thereof in the extending direction. Nevertheless, the locations of the first inlet 58*a*, the second inlet 58*b*, the first outlet 59*a*, and the second outlet 59*b* are not limited to the specific example such as the base end portions. In other embodiments, for example, the first inlet 58*a*, the second inlet 58*b*, the first outlet 59*a*, and the second outlet 59*b* might not necessarily be defined on respective end portions on the same side but may be defined on respective end portions on different sides in the respective corresponding manifolds. In accordance with a layout and/or shape of a channel through which liquid that is supplied into the first supply manifold 51*a* via the first inlet 58*a*, a channel through which liquid that is supplied into the second supply manifold 51*b* via the second inlet 58*b*, a channel through which liquid that flows out of the first return manifold 52*a* via the first outlet 59*a*, and a channel through which liquid that flows out of the second return manifold 52*b* via the second outlet 59*b*, the positions of the first inlet 58*a*, the second inlet 58*b*, the first outlet 59*a*, and the second outlet 59*b* may be determined as appropriate.

First Modification

Figure 8:
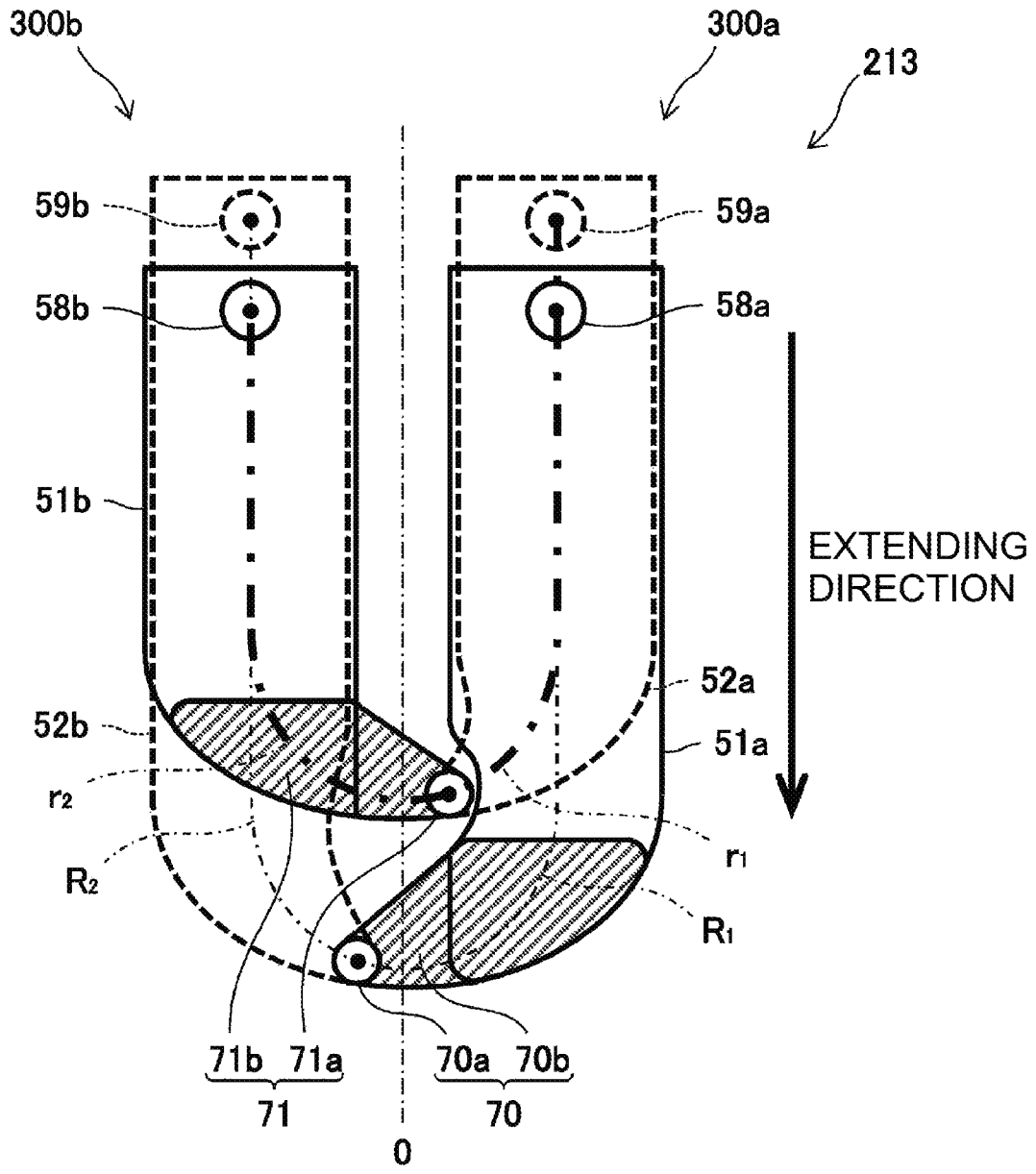
FIG. 8 is a partially enlarged schematic plan view of a head module according to a first modification of the illustrative embodiment, illustrating a positional relationship between a first supply manifold and a first return manifold, between a second supply manifold and a second return manifold, and between a first bypass path and a second bypass path.

Referring to FIG. 8, a head module 213 according to a first modification will be described. In FIG. 8, a first supply manifold 51*a* and a second supply manifold 51*b* are indicated by a solid line, and a first return manifold 52*a* and a second return manifold 52*b* are indicated by a dashed line. In FIG. 8, first individual channels 60*a* belonging to a first island portion 300*a* and second individual channels 60*b* belonging to a second island portion 300*b* are not illustrated.

In the head module 13 according to the illustrative embodiment, the center of the first bypass hole 70*a* of the first bypass path 70 and the center of the second bypass hole 71*a* of the second bypass path 71 are on the center line O.

Nevertheless, in the head module 213 according to the first modification, layout of the first supply manifold 51*a*, the first return manifold 52*a*, the second supply manifold 51*b*, and the second return manifold 52*b* is different from the layout of those in the head module 13 according to the illustrative embodiment.

More specifically, for example, as illustrated in FIG. 8, a first bypass path 70 and a second bypass path 71 are positioned such that the center of a first bypass hole 70*a* and the center of a second bypass hole 71*a* are apart from each other in a direction perpendicular to the extending direction.

In view of prevention of liquid leakage, the first bypass path 70 and the second bypass path 71 may need to be apart from each other by a certain distance. In a case where the center of the first bypass hole 70*a* and the center of the second bypass hole 71*a* are on the same straight line extending in the extending direction in like manner with the first bypass hole 70*a* and the second bypass hole 71*a* of the head module 13, the first bypass hole 70*a* and the second bypass hole 71*a* need to be apart from each other in the extending direction. Thus, in the head module 13, the first supply manifold 51*a* and the second return manifold 52*b* may need to be further elongated in the extending direction to locate the first bypass hole 70*a* and the second bypass hole 71*a* in such a manner, resulting in increase of the size of the head module 13 in the extending direction.

Nevertheless, in the head module 213 according to the first modification, the center of the first bypass hole 70*a* and the center of the second bypass hole 71*a* are apart from each other in the direction perpendicular to the extending direction. Thus, the first bypass hole 70*a* and the second bypass hole 71*a* might not necessarily be apart from each other by a certain distance in the extending direction, thereby reducing the size of the liquid ejection apparatus 1.

In the head module 213 according to the first modification, a distance $R_1$ from the center of a first inlet 58*a* of the first supply manifold 51*a* to the center of the first bypass hole 70*a* is equal to a distance $R_2$ from the center of a second outlet 59*b* of the second return manifold 52*b* to the center of the first bypass hole 70*a*. Further, a distance $r_1$ from the center of a first outlet 59*a* of the first return manifold 52*a* to the center of the second bypass hole 71*a* is equal to a distance $r_2$ from the center of a second inlet 58*b* of the second supply manifold 51*b* to the center of the second bypass hole 71*a*. Such a configuration may thus equalize channel resistance to liquid between a manifold belonging to the first island portion 300*a* and a manifold belonging to the second island portion 300*b* when the manifold circulation is implemented. Thus, an equal pressure may be applied to nozzle orifices 57 of the first individual channels 60*a* belonging to the first island portion 300*a* and nozzle orifices 57 of the second individual channels 60*b* belonging to the second island portion 300*b*. Consequently, such a configuration may reduce occurrences of meniscus breaks and variations in a meniscus shape due to locations, thereby reducing liquid ejection variations.

As illustrated in FIG. 8, in the head module 213 according to the first modification, a base end of the first supply manifold 51*a* and a base end of the second supply manifold 51*b* are substantially aligned with each other in the perpendicular direction. A base end of the first return manifold 52*a* and a base end of the second return manifold 52*b* are substantially aligned with each other in the perpendicular direction. Nevertheless, the base end of the first supply manifold 51*a* and the base end of the second supply manifold 51*b* might not necessarily be aligned with each other in the perpendicular direction. Further, the base end of the first return manifold 52*a* and the base end of the second return manifold 52*b* might not necessarily be aligned with each other in the perpendicular direction. However, the configuration in which the base end of the first supply manifold 51*a* and the base end of the second supply manifold 51*b* are aligned with each other in the perpendicular direction and the base end of the first return manifold 52*a* and the base end of the second return manifold 52*b* are aligned with each other in the perpendicular direction may enable the nozzle orifices 57 to be arranged with highly population as compared with the configuration in which the base end of the first supply manifold 51*a* and the base end of the second supply manifold 51*b* are not aligned with each other in the perpendicular direction and the base end of the first return manifold 52*a* and the base end of the second return manifold 52*b* are not aligned with each other in the perpendicular direction.

In the head module 213, the distance $R_1$ from the center of the first inlet 58*a* of the first supply manifold 51*a* to the center of the first bypass hole 70*a* may be equal to the distance $R_2$ from the center of the second outlet 59*b* of the second return manifold 52*b* to the center of the first bypass hole 70*a*. Further, the distance $r_1$ from the center of the first outlet 59*a* of the first return manifold 52*a* to the center of the second bypass hole 71*a* may also be equal to the distance $r_2$ from the center of the second inlet 58*b* of the second supply manifold 51*b* to the center of the second bypass hole 71*a*.

Second Modification

Figure 9A:
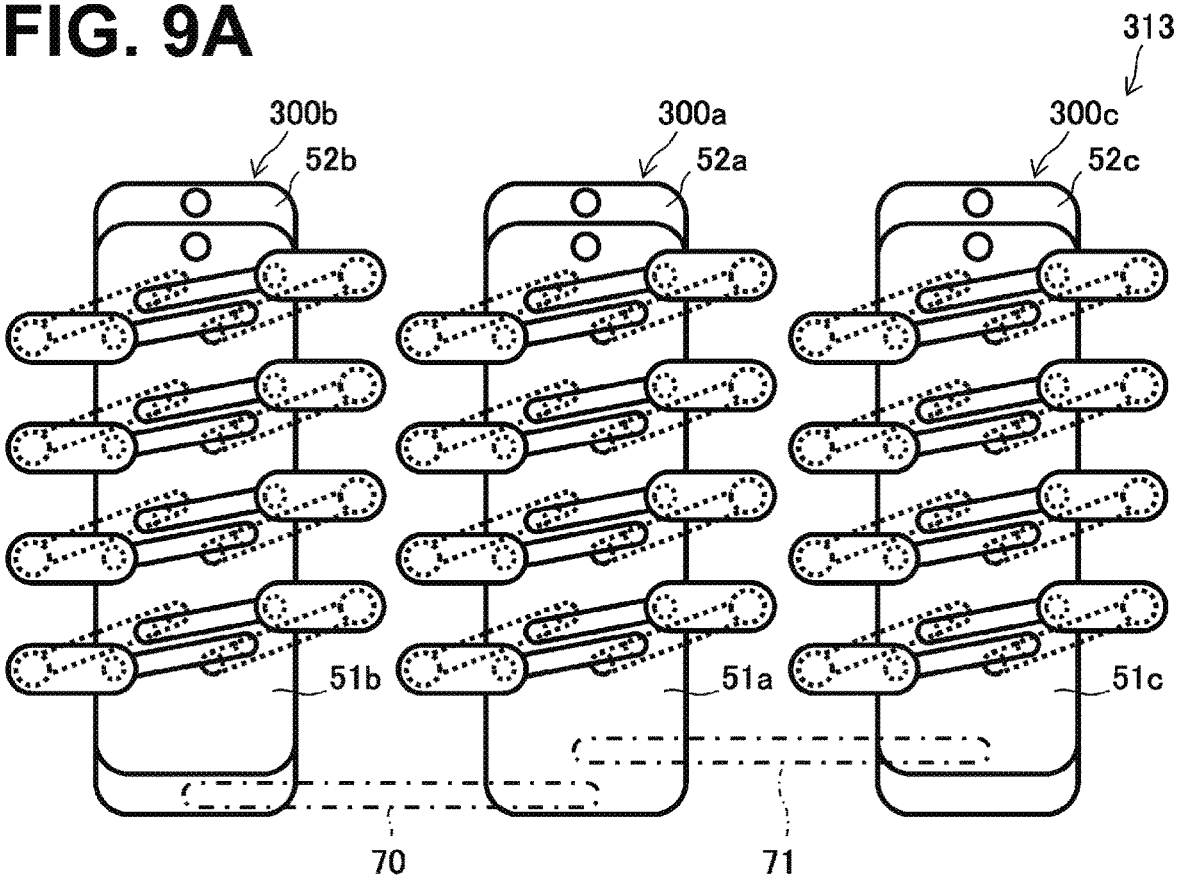
FIG. 9A is a partially enlarged schematic view of a head module according to a second modification of the illustrative embodiment, illustrating a planar structure of the head module.
Figure 9B:
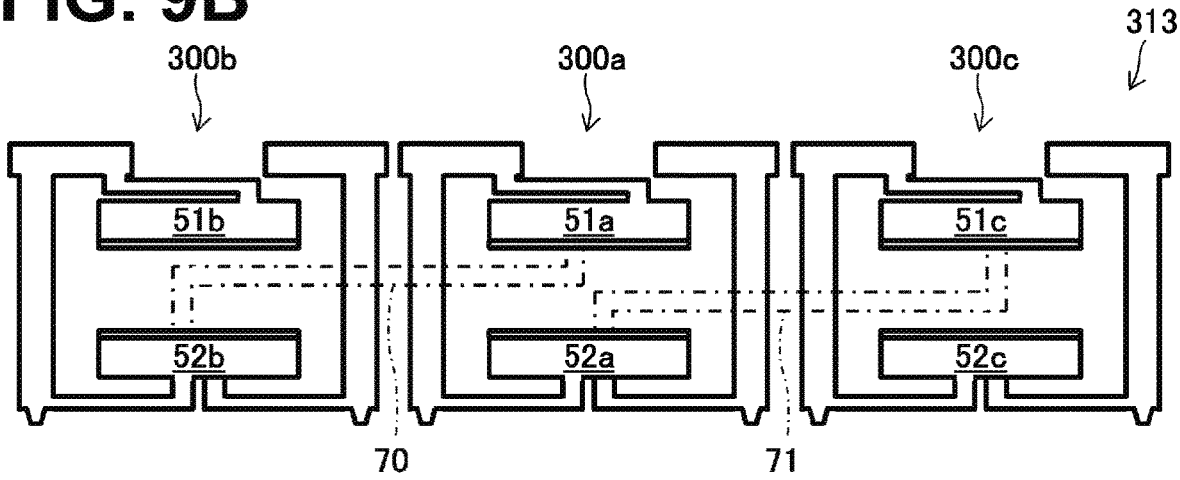
FIG. 9B is a partially enlarged schematic view of the head module according to the second modification of the illustrative embodiment, illustrating a cross sectional structure of the head module.

Referring to FIGS. 9A and 9B, one example of a head module 313 according to a second modification will be described. The head module 313 includes a piezoelectric plate. Nevertheless, for purposes of convenience, in FIGS. 9A and 9B, the piezoelectric plate is not illustrated. In FIG. 9B, for easy understanding of a positional relationship between a first bypass path 70 and a second bypass path 71, an area in which the first bypass path 70 and the second bypass path 71 are defined, that is, portions of plates in which a first damper portion 55*a* and a second damper portion 55*b* are defined, are enlarged.

In the head module 13 according to the illustrative embodiment, a supply manifold belonging to one of the first island portion 300*a* and the second island portion 300*b* and a return manifold belonging to the other of the first island portion 300*a* and the second island portion 300*b* are in fluid communication with each other to enable the manifold circulation between the first island portion 300*a* and the second island portion 300*b*. Nevertheless, in the one example, as illustrated in FIGS. 9A and 9B, the head module 313 according to the second modification includes a first island portion 300*a*, a second island portion 300*b*, and a third island portion 300*c*. A first supply manifold 51*a* belonging to the first island portion 300*a* is in fluid communication with a second return manifold 52*b* belonging to the second island portion 300*b*. A first return manifold 52*a* belonging to the first island portion 300*a* is in fluid communication with a third supply manifold 51*c* belonging to the third island portion 300*c*.

The third island portion 300*c* includes the third supply manifold 51*c* and a third return manifold 52*c*, each of which is in fluid communication with individual channels. As illustrated in FIGS. 9A and 9B, the third island portion 300*c* is located across the first island portion 300*a* from the second island portion 300*b*. The third island portion 300*c* may have the same configuration as the first island portion 300*a* and the second island portion 300*b*, and therefore, the detailed description of the third island portion 300*c* is omitted. In the head module 313 according to the second modification, the first supply manifold 51*a* of the first island portion 300*a* is in fluid communication with the second return manifold 52*b* of the second island portion 300*b* via a first bypass path 70. The first return manifold 52*a* of the first island portion 300*a* is in fluid communication with the third supply manifold 51*c* of the third island portion 300*c* via a second bypass path 71.

A possibility that individual channels belonging to the respective different island portions (e.g., the first island portion 300*a*, the second island portion 300*b*, and the third island portion 300*c*) eject liquid droplets at the same timing may be less than a possibility that individual channels belonging to the same island portion eject liquid droplets at the same timing.

Thus, a possibility that a pressure wave propagating through the first supply manifold 51*a* is in the same phase as a pressure wave propagating through the second return manifold 52*b* may be reduced, thereby being less susceptible to effect of crosstalk even if the pressure waves merge with each other. In addition, a possibility that a pressure wave propagating through the third supply manifold 51*c* is in the same phase as a pressure wave propagating through the first return manifold 52*a* may be reduced, thereby being less susceptible to effect of crosstalk even if the pressure waves merge with each other.

Figure 10:
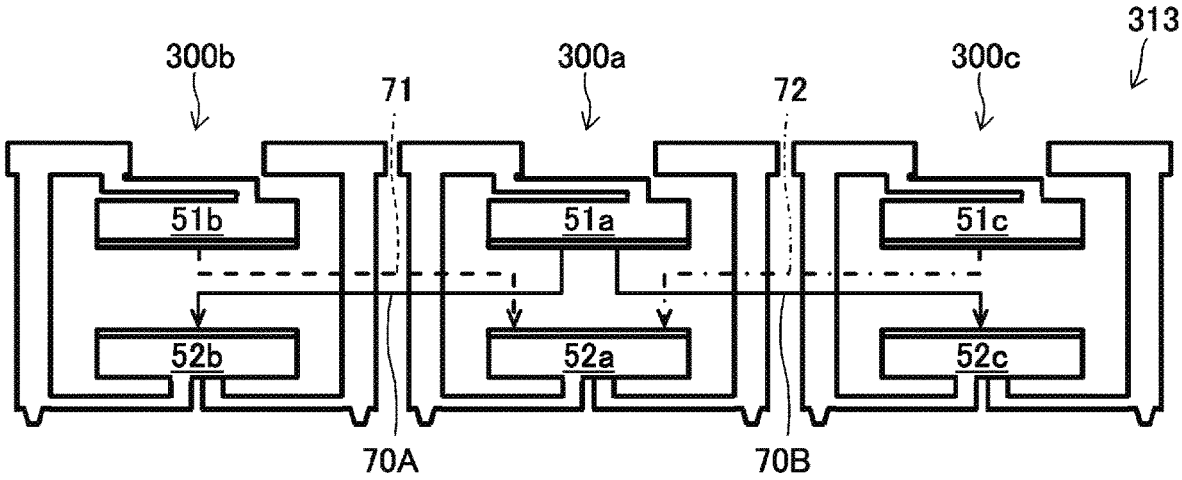
FIG. 10 is a schematic sectional view of the head module according to the second modification of the illustrative embodiment, illustrating an example liquid flow route in the head module.

In the one example of the second modification, the head module 313 includes three island portions. More specifically, for example, the first supply manifold 51*a* of the first island portion 300*a* is in fluid communication with the second return manifold 52*b* of the second island portion 300*b*, and the first return manifold 52*a* of the first island portion 300*a* is in fluid communication with the third supply manifold 51*c* of the third island portion 300*c*. Nevertheless, the routing of the bypass paths connecting the supply manifolds and the return manifolds between the first island portion 300*a*, the second island portion 300*b*, and the third island portion 300*c* is not limited to the above example. In another example, as illustrated in FIG. 10, in a head module 313, supply manifolds and return manifolds are in fluid communication with each other such that liquid can flow by routes indicated by direction arrows. In FIG. 10, each liquid flow direction is indicated by an arrow in the sectional view illustrating the configuration of the head module 313.

More specifically, for example, a first supply manifold 51*a* belonging to a first island portion 300*a* is in fluid communication with a second return manifold 52*b* belonging to a second island portion 300*b* via a first bypass path 70A and is also in fluid communication with a third return manifold 52*c* belonging to a third island portion 300*c* via a first bypass path 70B. A second supply manifold 51*b* belonging to the second island portion 300*b* is in fluid communication with a first return manifold 52*a* belonging to the first island portion 300*a* via a second bypass path 71. A third supply manifold 51*c* belonging to the third island portion 300*c* is in fluid communication with the first return manifold 52*a* belonging to the first island portion 300*a* via a third bypass path 72. In FIG. 10, the liquid flow direction in which liquid flows through the first bypass path 70A or through the first bypass path 70B is indicated by a solid line. The liquid flow direction in which liquid flows through the second bypass path 71 is indicated by a dashed line. The liquid flow direction in which liquid flows through the third bypass path 72 is indicated by a dotted-and-dashed line.

In the head module 313 having such a configuration, a possibility that a pressure wave propagating through the first supply manifold 51*a*, a pressure wave propagating through the second return manifold 52*b*, and a pressure wave propagating through the third return manifold 52*c* are in the same phase may be reduced, thereby being less susceptible to effect of crosstalk even if the pressure waves merge with each other. In addition, a possibility that a pressure wave propagating through the second supply manifold 51*b*, a pressure wave propagating through the third supply manifold 51*c*, and a pressure wave propagating through the first return manifold 52*a* are in the same phase may be reduced, thereby being less susceptible to effect of crosstalk even if the pressure waves merge with each other.

Figure 11:
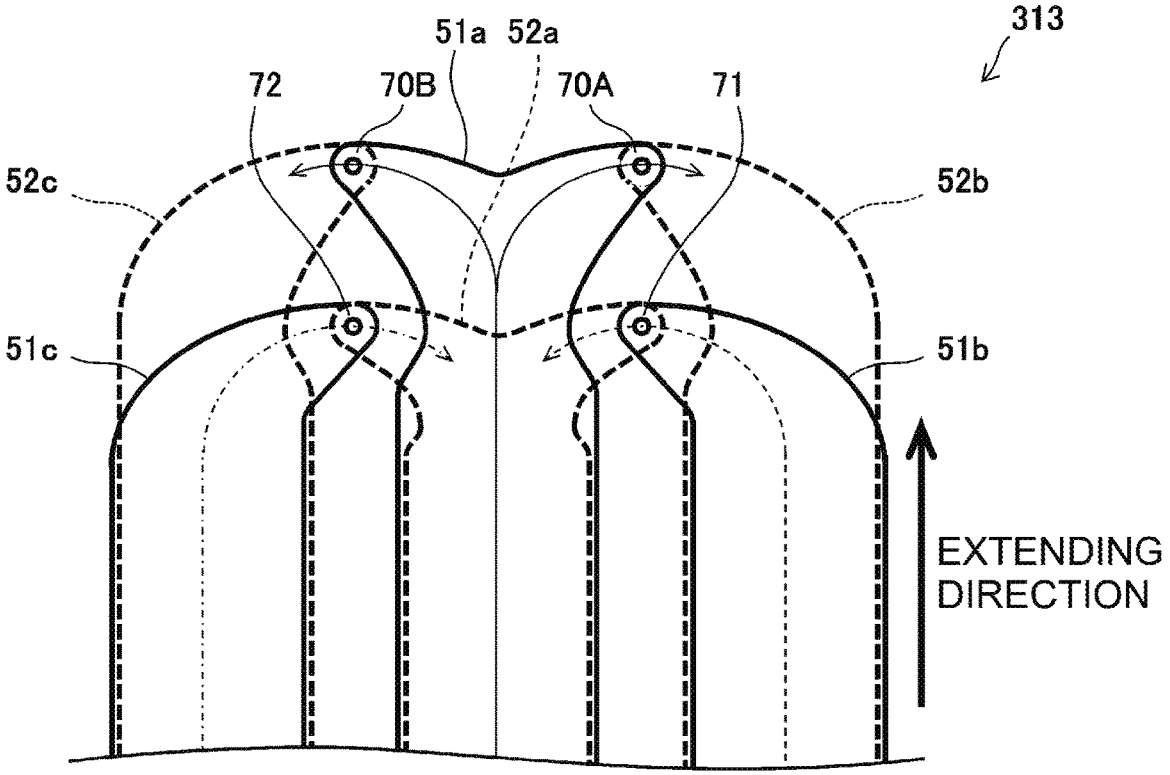
FIG. 11 is a partially enlarged schematic plan view of the head module according to the second modification of the illustrative embodiment, illustrating a positional relationship between a first supply manifold and a first return manifold, between a second supply manifold and a second return manifold, between a third supply manifold and a third return manifold, and between a first bypass path, a second bypass path, and a third bypass path.

For allowing liquid to flow by the routes as illustrated in FIG. 10, for example, the head module 313 may have a configuration illustrated in FIG. 11.

In FIG. 11, the first supply manifold 51*a*, the second supply manifold 51*b*, and the third supply manifold 51*c* are indicated by a solid line, and the first return manifold 52*a*, the second return manifold 52*b*, and the third return manifold 52*c* are indicated by a dashed line. First individual channels 60*a* belonging to the first island portion 300*a*, second individual channels 60*b* belonging to the second island portion 300*b*, third individual channels 60*c* belonging to the third island portion 300*c* are not illustrated.

The first supply manifold 51*a* has a front end portion in the extending direction. The front end portion of the first supply manifold 51*a* bifurcates into a right portion and a left portion. The right portion of the front end portion of the first supply manifold 51*a* in the extending direction is substantially aligned with a front end portion of the second return manifold 52*b* in the extending direction with respect to the perpendicular direction. The first bypass path 70A connects between the front end portion of the first supply manifold 51*a* and the front end portion of the second return manifold 52*b*. The left portion of the front end portion of the first supply manifold 51*a* in the extending direction is substantially aligned with a front end portion of the third return manifold 52*c* in the extending direction with respect to the perpendicular direction. The first bypass path 70B connects between the front end portion of the first supply manifold 51*a* and the front end portion of the third return manifold 52*c*.

The first return manifold 52*a* has a front end portion in the extending direction. The front end portion of the first return manifold 52*a* bifurcates into a right portion and a left portion. A front end portion of the second supply manifold 51*b* in the extending direction is substantially aligned with the right portion of the front end portion of the first return manifold 52*a* in the extending direction with respect to the perpendicular direction. The second bypass path 71 connects between the front end portion of the second supply manifold 51*b* and the front end portion of the first return manifold 52*a*. A front end portion of the third supply manifold 51*c* in the extending direction is substantially aligned with the left portion of the front end portion of the first return manifold 52*a* in the extending direction. The third bypass path 72 connects between the front end portion of the third supply manifold 51*c* and the front end portion of the first return manifold 52*a*.

As illustrated in FIG. 11, in the first supply manifold 51*a*, liquid flows separately into the right portion and the left portion of the front end portion of the first supply manifold 51*a*. Liquid flowing in the right portion of the front end portion of the first supply manifold 51*a* then flows into the second return manifold 52*b* via the first bypass path 70A. Liquid flowing in the left portion of the front end portion of the first supply manifold 51*a* then flows into the third return manifold 52*c* via the first bypass path 70B. Liquid flowing in the second supply manifold 51*b* flows into the right portion of the front end portion of the first return manifold 52*a* via the second bypass path 71. Liquid flowing in the third supply manifold 51*c* flows into the left portion of the front end portion of the first return manifold 52*a* via the third bypass path 72. Liquid flowing into the first return manifold 52*a* via the second bypass path 71 and via the third bypass path 72 is gathered in the first return manifold 52*a* and flows in a direction opposite to the liquid flow direction in which liquid flows in the first supply manifold 51*a*.

Third Modification

In the head module 13 according to the illustrative embodiment, the head module 213 according to the first modification, and the head modules 313 according to the second modification, the first island portion 300*a* includes the first supply manifold 51*a* and the first return manifold 52*a* and the second island portion 300*b* includes the second supply manifold 51*b* and the second return manifold 52*b*. In such a configuration, a bypass path may provide fluid communication between a supply manifold of one island portion and a return manifold of another island portion located next to the one island portion. Such a configuration may reduce effect of crosstalk in a case where a pressure wave propagating through the supply manifold and a pressure wave propagating through the return manifold merge with each other.

Figure 12A:
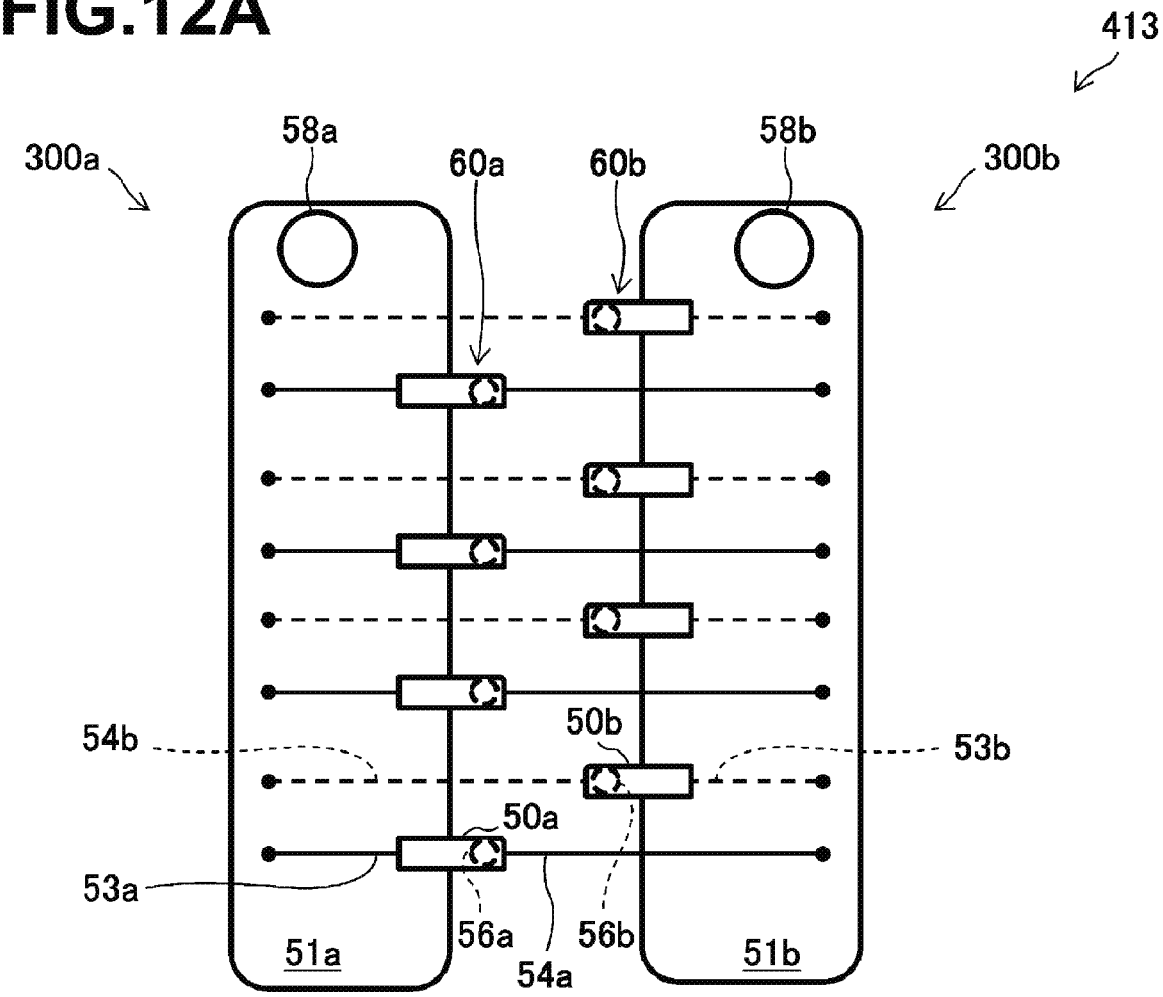
FIG. 12A is a partially enlarged schematic view of a head module according to a third modification of the illustrative embodiment, illustrating a planar structure of the head module.
Figure 12B:
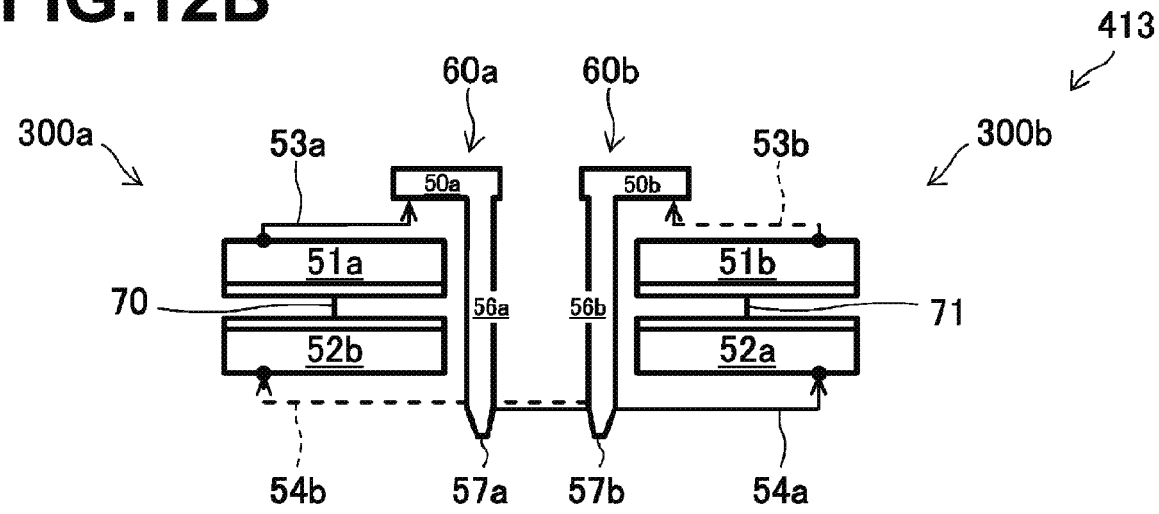
FIG. 12B is a partially enlarged cross sectional schematic view of the head module according to the third modification of the illustrative embodiment, illustrating an example liquid flow route in the head module.

According to a third modification, in a head module 413, a first supply manifold 51*a* belongs to a first island portion 300*a* and a first return manifold 52*a* belongs to a second island portion 300*b*. The first island portion 300*a* and the second island portion 300*b* are located next to and connected to each other via return narrowed portions. Such a configuration may achieve the same effect as that achieved by the head module 13 according to the illustrative embodiment, the head module 213 according to the first modification, and the head modules 313 according to the second modification. Referring to FIGS. 12A and 12B, a configuration of the head module 413 according to the third modification will be described. In FIGS. 12A and 12B, for easy understanding a relationship between individual channels, each island portion may include a single nozzle row. In FIG. 12B, a liquid flow direction in which liquid flows through a first individual channel 60*a* is indicated by a solid line, and a liquid flow direction in which liquid flows through a second individual channel 60*b* is indicated by a dashed line.

In the head module 13 according to the illustrative embodiment, the head module 213 according to the first modification, and the head modules 313 according to the second modification, the first supply manifold 51*a* belonging to the first island portion 300*a* and the second return manifold 52*b* belonging to the second return manifold 52*b* are in fluid communication with each other via the first bypass path 70, and some liquid in the first supply manifold 51*a* flows into the second return manifold 52*b* to implement the manifold circulation. Nevertheless, in the head module 413 according to the third modification, liquid in the first supply manifold 51*a* belonging to the first island portion 300*a* is allowed to flow into the first return manifold 52*a* belonging to the second island portion 300*b* via a first individual channel 60*a*. Some remaining liquid in the second supply manifold 51*b* that has not flowed into a second individual channel 60*b* is allowed to flow into the first return manifold 52*a* via the second bypass path 71. Liquid in the first return manifold 52*a* is then returned to a corresponding tank 16 via a second outlet 59*b*. As described above, the nozzle circulation and the manifold circulation may be implemented in the head module 413.

More specifically, for example, as illustrated in FIGS. 12A and 12B, the head module 413 includes the first island portion 300*a* including first individual channels 60*a* and the second island portion 300*b* including second individual channels 60*b*. The first island portion 300*a* and the second island portion 300*b* are positioned next to each other.

When viewed in plan from a nozzle surface of the head module 413, the first supply manifold 51*a* and the second return manifold 52*b* overlap each other in the first island portion 300*a* and the second supply manifold 51*b* and the first return manifold 52*a* overlap each other in the second island portion 300*b*.

The first supply manifold 51*a* is in fluid communication with a first pressure chamber 50*a* of a first individual channel 60*a* via a first supply narrowed portion 53*a*. The first pressure chamber 50*a* is in fluid communication with one end of a first descender 56*a*. The first descender 56*a* has a first nozzle orifice 57*a* at the other end thereof. Liquid is allowed to flow into the first pressure chamber 50*a* from the first supply manifold 51*a* via a first supply narrowed portion 53*a*. The head module 413 further includes a piezoelectric plate (i.e., a piezoelectric body) above the first pressure chamber 50*a*. The piezoelectric plate is configured to apply pressure to liquid in the first pressure chamber 50*a* at a certain timing. Thus, the head module 413 may eject a liquid droplet from the first nozzle orifice 57*a* corresponding to the first pressure chamber 50*a* at a certain timing. Liquid not ejected from the first nozzle orifice 57*a* is allowed to flow into the first return manifold 52*a* belonging to the second island portion 300*b* via the first return narrowed portion 54*a*. Some remaining liquid in the second supply manifold 51*b* that has not flowed into the second individual channel 60*b* is allowed to flow into the first return manifold 52*a* via the second bypass path 71. Liquid in the first return manifold 52*a* is then returned to a corresponding tank 16 via a second outlet 59*b*. As described above, the nozzle circulation and the manifold circulation may be implemented in the head module 413.

The second supply manifold 51*b* is in fluid communication with a second pressure chamber 50*b* of a second individual channel 60*b* via a second supply narrowed portion 53*b*. The second pressure chamber 50*b* is in fluid communication with one end of a second descender 56*b*. The second descender 56*b* has a second nozzle orifice 57*b* at the other end thereof. Liquid is allowed to flow into the second pressure chambers 50*b* from the second supply manifold 51*b* via a second supply narrowed portions 53*b*. The piezoelectric plate (i.e., a piezoelectric body) is disposed above the second pressure chamber 50*b*. The piezoelectric plate is configured to apply pressure to liquid in the second pressure chambers 50*b* at a certain timing. Thus, the head module 413 may eject a liquid droplet from the second nozzle orifice 57*b* corresponding to the second pressure chamber 50*b* at a certain timing. Liquid not ejected from the second nozzle orifice 57*b* is allowed to flow into the second return manifold 52*b* belonging to the first island portion 300*a* via the second return narrowed portion 54*b*. Some remaining liquid in the first supply manifold 51*a* that has not flowed into the first individual channel 60*a* is allowed to flow into the second return manifold 52*b* via the first bypass path 70. Liquid in the second return manifold 52*b* is then returned to a corresponding tank 16 via a first outlet 59*a*. As described above, the nozzle circulation and the manifold circulation may be implemented in the head module 413.

In the head module 413 according to the third modification, the first individual channel 60*a* belonging to the first island portion 300*a* is in fluid communication with the first supply manifold 51*a* belonging to the same first island portion 300*a* via the first supply narrowed portion 53*a* and is also in fluid communication with the first return manifold 52*a* belonging to the second island portion 300*b* located next to the first island portion 300*a* via the first return narrowed portion 54*a*. As compared with a configuration in which both of the first supply manifold 51*a* and the first return manifold 52*a* belong to the same first island portion 300*a*, the configuration according to the third modification may enable the head module 413 to have a longer first return narrowed portion 54*a*, thereby applying a desired level of resistance to liquid flowing through the first return narrowed portion 54*a*.

In a similar manner to the first individual channel 60*a*, the second individual channel 60*b* belonging to the second island portion 300*b* is in fluid communication with the second supply manifold 51*b* belonging to the same second island portion 300*b* via the second supply narrowed portion 53*b* and is also in fluid communication with the second return manifold 52*b* belonging to the first island portion 300*a* located next to the second island portion 300*b* via the second return narrowed portion 54*b*. As compared with a configuration in which both of the second supply manifold 51*b* and the second return manifold 52*b* belong to the same second island portion 300*b*, the configuration according to the third modification may enable the head module 413 to have a longer second return narrowed portion 54*b*, thereby applying a desired level of resistance to liquid flowing through the second return narrowed portion 54*b*.

As described above, in the head module 413, two different island portions may be bidirectionally connected to each other via the first return narrowed portions 54*a* and the second return narrowed portions 54*b*. Nevertheless, instead of such a configuration, for example, each island portion may be unidirectionally connected to a respective adjacent island portion located to one side thereof. More specifically, for example, a first individual channel 60*a* belonging to a first island portion 300*a* may be in fluid communication with a first return manifold 52*a* belonging to a second island portion 300*b* located to the one side of and next to the first island portion 300*a* via a first return narrowed portion 54*a*. A second individual channel 60*b* belonging to the second island portion 300*b* may be in fluid communication with a second return manifold 52*b* belonging to another island portion located to the one side of and next to the second island portion 300*b* via a second return narrowed portion 54*b*. In such a case, however, for implementing the nozzle circulation and the manifold circulation of liquid flowing through the first individual channel 60*a* and liquid flowing through the second individual channel 60*b*, at least three island portions and three individual channels belonging to respective corresponding island portions.

According to the third modification, in the head module 413, as described above, liquid flowing through the first individual channel 60*a* and liquid flowing through the second individual channel 60*b* are allowed to bidirectionally flow between the first island portion 300*a* and the second island portion 300*b* to implement the nozzle circulation and the manifold circulation. With this configuration, the nozzle circulation and the manifold circulation may be achieved by only at least two island portions and two individual channels belonging to the respective island portions. Such a configuration may decrease required number of individual channels and enable the first individual channel 60*a* and the second individual channel 60*b* to be located close to each other. Consequently, the head module 413 of the third modification may include individual channels at highly populated density.

Figure 13:
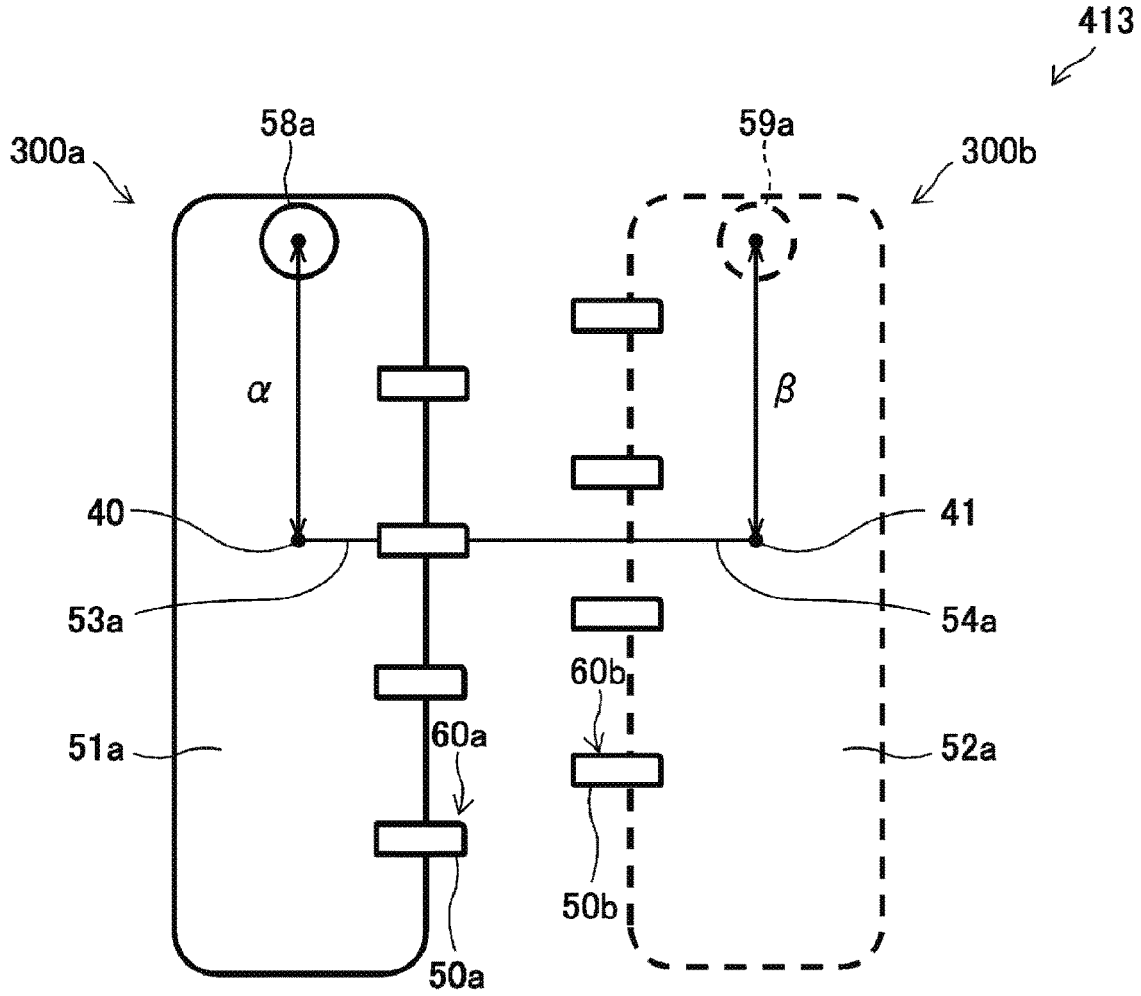
FIG. 13 is a schematic sectional view of the head module according to the third modification of the illustrative embodiment, illustrating a positional relationship between a supply narrowed portion and a return narrowed portion in each individual channel of the head module.

In the head module 413 of the third modification, for example, a supply narrowed portion and a return narrowed portion may be positioned as illustrated in FIG. 13. A plurality of first individual channels 60*a* are aligned in a longer direction of a first island portion 300*a*. Hereinafter, one of the first individual channels 60*a* will be described representatively.

The first supply manifold 51*a* and the first supply narrowed portion 53*a* of the first individual channel 60*a* are in fluid communication with each other via a first connecting portion 40. The first return manifold 52*a* and the first return narrowed portion 54*a* of the first individual channel 60*a* are in fluid communication with each other via a second connecting portion 41. As illustrated in FIG. 13, a distance $\alpha$ from the center of a first inlet 58*a* to the first connecting portion 40 is equal to a distance $\beta$ from the center of a first outlet 59*a* to the second connecting portion 41.

The first supply manifold 51*a* is at a positive pressure for allowing liquid to flow into the first individual channel 60*a*. The first return manifold 52*a* is at a negative pressure for allowing liquid not ejected from the first nozzle orifice 57*a* to flow thereinto. As illustrated in FIG. 13, the distance $\alpha$ and the distance β are equal to each other under such conditions. Thus, in the head module 413 according to the third modification, pressure to be applied to liquid at a first nozzle orifice 57*a* located between the first supply narrowed portion 53*a* and the first return narrowed portion 54*a* in the liquid flow route may be controlled to an appropriate level of pressure.

Consequently, the head module 413 may eject liquid straightly toward a recording sheet P from the first nozzle orifice 57*a*.

The second individual channels 60*b* are arranged in the second island portion 300*b* in a row extending in the same direction as the direction in which the first individual channels 60*a* are arranged. The second connecting portion 41 is disposed between adjacent second individual channels 60*b*. In one example, as illustrated in FIG. 13, the first individual channels 60*a* and the second individual channels 60*b* are arranged in respective rows and in a staggered pattern. Such an arrangement may thus enable the first supply narrowed portion 53*a* and the first return narrowed portion 54*a* to be in line with each other when the head module 413 is viewed in plan.

As described above, the second connecting portion 41 is disposed between adjacent second individual channels 60*b*. With this arrangement, the first return narrowed portion 54*a* might not obstruct the arrangement of the second individual channels 60*b* in the second island portion 300*b*.

In the specific example illustrated in FIG. 13, the first supply narrowed portion 53*a* and the first return narrowed portion 54*a* are in line with each other. Nevertheless, the positional relationship between the first supply narrowed portion 53*a* and the first return narrowed portion 43*a* is not limited to such a specific example as long as the distance α and the distance β are equal to each other.

Fourth Modification

Figure 14:
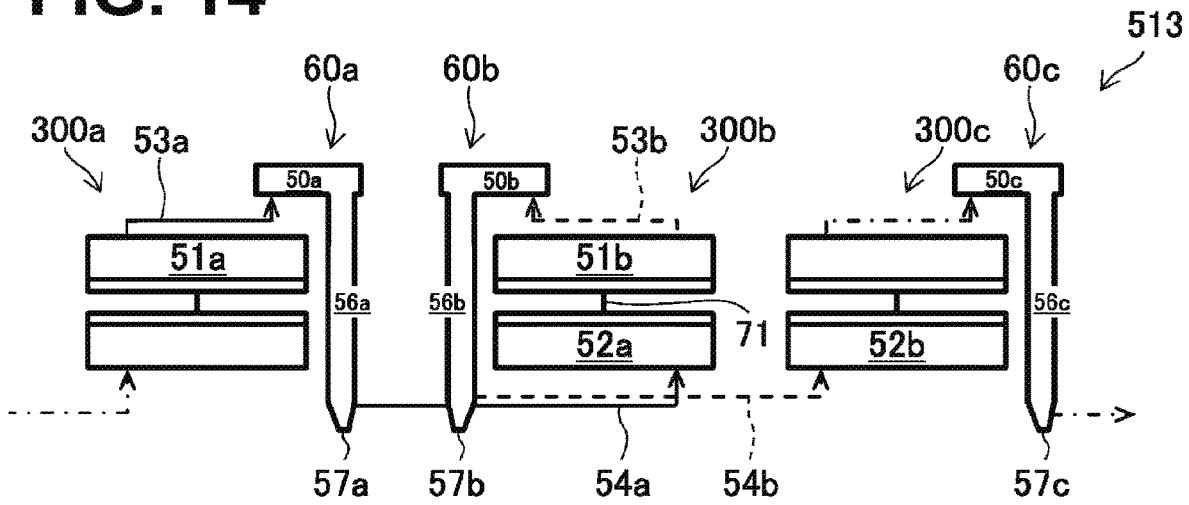
FIG. 14 is a schematic sectional view of a head module according a fourth modification of the illustrative embodiment, illustrating an example liquid flow route in the head module.

Referring to FIG. 14, a configuration of a head module 513 according to a fourth modification will be described. In the head module 513, each individual channel belonging to a respective island portion is in fluid communication with a corresponding return manifold belonging to another respective island portion located to the one side of and adjacent to the island portion to which each of the individual channels belongs.

More specifically, for example, the head module 513 includes a first supply manifold 51*a* belonging to a first island portion 300*a*, and a second supply manifold 51*b* and a first return manifold 52*a* both belonging to a second island portion 300*b*. The head module 513 further includes a second return manifold 52*b* belonging to a third island portion 300*c* including third individual channels 60*c* (only one of the third individual channels 60*c* is illustrated in FIG. 14). Each of the third individual channels 60*c* includes a third pressure chamber 50*c*, a third descender 56*c*, and a third nozzle orifice 57*c*. When viewed in plan from a nozzle surface of the head module 513, the first supply manifold 51*a* and a return manifold overlap each other in the first island portion 300*a* and the second supply manifold 51*b* and the first return manifold 52*a* overlap each other in the second island portion 300*b*. When viewed in plan from the nozzle surface, a supply manifold and the second return manifold 52*b* overlap each other in the third island portion 300*c*.

In the first island portion 300*a*, the first supply manifold 51*a* is in fluid communication with a first pressure chamber 50*a* of a first individual channel 60*a* via a first supply narrowed portion 53*a*. The first pressure chamber 50*a* is in fluid communication with one end of a first descender 56*a*. The first descender 56*a* has a first nozzle orifice 57*a* at the other end thereof. Liquid is allowed to flow into the first pressure chamber 50*a* from the first supply manifold 51*a* via the first supply narrowed portion 53*a* and to be ejected in droplet form from the first nozzle orifice 57*a* at a certain timing. Liquid not ejected from the first nozzle orifice 57*a* is allowed to flow into the first return manifold 52*a* belonging to the second island portion 300*b* via the first return narrowed portion 54*a*. Some remaining liquid in the second supply manifold 51*b* that has not flowed into a second individual channel 60*b* is allowed to flow into the first return manifold 52*a* via the second bypass path 71. Liquid in the first return manifold 52*a* is then returned to a corresponding tank 16 via a second outlet 59*b*. As described above, the nozzle circulation and the manifold circulation may be implemented in the head module 513.

In the second island portion 300*b*, the second supply manifold 51*b* is in fluid communication with a second pressure chamber 50*b* of a second individual channel 60*b* via a second supply narrowed portion 53*b*. The second pressure chamber 50*b* is in fluid communication with one end of a second descender 56*b*. The second descender 56*b* has a second nozzle orifice 57*b* at the other end thereof. Liquid is allowed to flow into the second pressure chamber 50*b* from the second supply manifold 51*b* via the second supply narrowed portion 53*b* and to be ejected in droplet form from the second nozzle orifice 57*b* at a certain timing. Liquid not ejected from the second nozzle orifice 57*b* is allowed to flow into the second return manifold 52*b* belonging to the third island portion 300*c* via the second return narrowed portion 54*b*. Liquid in the second return manifold 52*b* is then returned to a corresponding tank 16 via a third outlet.

According to the fourth modification, the nozzle circulation and the manifold circulation may be implemented between two individual channels (e.g., between the first individual channel 60*a* and the second individual channel 60*b*). Nevertheless, in another example, the nozzle circulation and the manifold circulation may be implemented between three individual channels (e.g., between the first individual channel 60*a*, the second individual channel 60*b*, and the third individual channel 60*c*).

Fifth Modification

Figure 15:
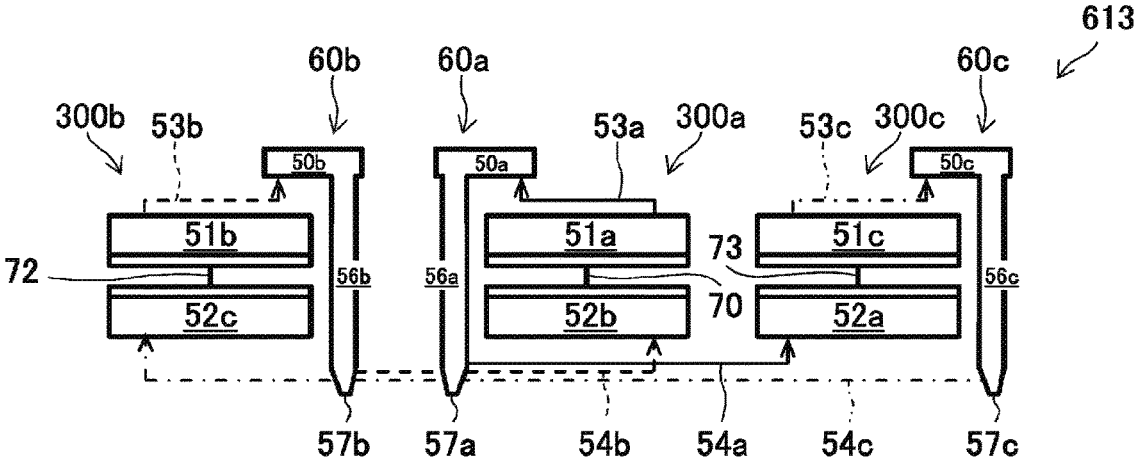
FIG. 15 is a schematic sectional view of a head module according a fifth modification of the illustrative embodiment, illustrating an example liquid flow route in the head module.

Referring to FIG. 15, a configuration of a head module 613 according to a fifth modification will be described. The head module 613 is configured to implement the nozzle circulation and the manifold circulation between three individual channels. In the head module 613, a third island portion 300*c* including third individual channels 60*c* (only one of the third individual channels 60*c* is illustrated) is disposed to the one side (e.g., to the right) of a first island portion 300*a* including first individual channels 60*a* (only one of the first individual channels 60*a* is illustrated). A second island portion 300*b* including second individual channels 60*b* (only one of the second individual channels 60*b* is illustrated) is disposed to the other side (e.g., to the left) of the first island portion 300*a*.

When viewed in plan from a nozzle surface of the head module 613, in the first island portion 300*a* of the head module 613, a first supply manifold 51*a* and a second return manifold 52*b* overlap each other and are in fluid communication with each other via a first bypass path 70. In the second island portion 300*b*, a second supply manifold 51*b* and a third return manifold 52*c* overlap each other and are in fluid communication with each other via a third bypass path 72. In the third island portion 300*c*, a third supply manifold 51*c* and a first return manifold 52*a* overlap each other and are in fluid communication with each other via a fourth bypass path 73.

In the first island portion 300*a*, the first supply manifold 51*a* is in fluid communication with a first pressure chamber 50*a* of a first individual channel 60*a* via a first supply narrowed portion 53*a*. The first pressure chamber 50*a* is in fluid communication with one end of a first descender 56*a*. The first descender 56*a* has a first nozzle orifice 57*a* at the other end thereof. Liquid is allowed to flow into the first pressure chamber 50*a* from the first supply manifold 51*a* via the first supply narrowed portion 53*a* and to be ejected in droplet form from the first nozzle orifice 57*a* at a certain timing. Liquid not ejected from the first nozzle orifice 57*a* is allowed to flow into the first return manifold 52*a* belonging to the third island portion 300*c* via the first return narrowed portion 54*a*. Some remaining liquid in the third supply manifold 51*c* that has not flowed into a third individual channel 60*c* is allowed to flow into the first return manifold 52*a* via the fourth bypass path 73. Liquid in the first return manifold 52*a* is then returned to a corresponding tank 16 via a third outlet. As described above, the nozzle circulation and the manifold circulation may be implemented in the head module 613.

In the third island portion 300*c*, the third supply manifold 51*c* is in fluid communication with a third pressure chamber 50*c* of a third individual channel 60*c* via a third supply narrowed portion 53*c*. The third pressure chamber 50*c* is in fluid communication with one end of a third descender 56*c*. The third descender 56*c* has a third nozzle orifice 57*c* at the other end thereof. Liquid is allowed to flow into the third pressure chamber 50*c* from the third supply manifold 51*c* via the third supply narrowed portion 53*c* and to be ejected in droplet form from the third nozzle orifice 57*c* at a certain timing. Liquid not ejected from the third nozzle orifice 57*c* is allowed to flow into the third return manifold 52*c* belonging to the second island portion 300*b* via the third return narrowed portion 54*c*. Some remaining liquid in the second supply manifold 51*b* that has not flowed into a second individual channel 60*b* is allowed to flow into the third return manifold 52*c* via the third bypass path 72. Liquid in the third return manifold 52*c* is then returned to a corresponding tank 16 via a second outlet 59*b*. As described above, the nozzle circulation and the manifold circulation may be implemented in the head module 613.

In the second island portion 300*b*, the second supply manifold 51*b* is in fluid communication with a second pressure chamber 50*b* of a second individual channel 60*b* via a second supply narrowed portion 53*b*. The second pressure chamber 50*b* is in fluid communication with one end of a second descender 56*b*. The second descender 56*b* has a second nozzle orifice 57*b* at the other end thereof. Liquid is allowed to flow into the second pressure chamber 50*b* from the second supply manifold 51*b* via the second supply narrowed portion 53*b* and to be ejected in droplet form from the second nozzle orifice 57*b* at a certain timing. Liquid not ejected from the second nozzle orifice 57*b* is allowed to flow into the second return manifold 52*b* belonging to the first island portion 300*a* via the second return narrowed portion 54*b*. Some remaining liquid in the first supply manifold 51*a* that has not flowed into the first individual channel 60*a* is allowed to flow into the second return manifold 52*b* via the first bypass path 70. Liquid in the second return manifold 52*b* is then returned to a corresponding tank 16 via a first outlet 59*a*. As described above, the nozzle circulation and the manifold circulation may be implemented in the head module 613.

According to the fifth modification, the head module 613 may implement the nozzle circulation and the manifold circulation between three individual channels (e.g., between the first individual channel 60*a*, the second individual channel 60*b*, and the third individual channel 60*c*), and reduce effect of crosstalk caused by pressure wave propagation.

Sixth Modification

Figure 16:
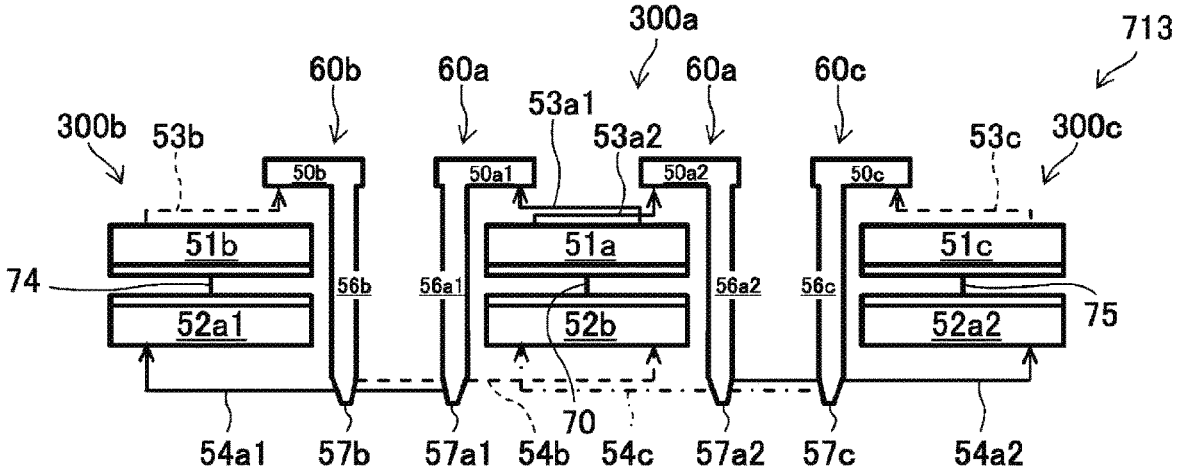
FIG. 16 is a schematic sectional view of a head module according a sixth modification of the illustrative embodiment, illustrating an example liquid flow route in the head module.

The one example configuration has been described in the fifth modification in which the nozzle circulation and the manifold circulation may be implemented between three individual channels (e.g., between the first individual channel 60*a*, the second individual channel 60*b*, and the third individual channel 60*c*). Nevertheless, such a configuration is not limited to the one example configuration. Referring to FIG. 16, another example of such a configuration according to a sixth modification will be described.

When viewed in plan from a nozzle surface of a head module 713, in a first island portion 300*a*, a first supply manifold 51*a* and a second return manifold 52*b* overlap each other and are in fluid communication with each other via a first bypass path 70. In a second island portion 300*b*, a second supply manifold 51*b* and a first return manifold 52*a*1 overlap each other and are in fluid communication with each other via a fifth bypass path 74. In a third island portion 300*c*, a third supply manifold 51*c* and a first return manifold 52*a*2 overlap each other and are in fluid communication with each other via a sixth bypass path 75.

In the first island portion 300*a*, the first supply manifold 51*a* is in fluid communication with a first pressure chamber 50*a*1 of a first individual channel 60*a* via a first supply narrowed portion 53*a*1. The first pressure chamber 50*a*1 is in fluid communication with one end of a first descender 56*a*1. The first descender 56*a*1 has a first nozzle orifice 57*a*1 at the other end thereof. Liquid is allowed to flow into the first pressure chamber 50*a*1 from the first supply manifold 51*a* via the first supply narrowed portions 53*a*1 and to be ejected in droplet form from the first nozzle orifice 57*a*1 at a certain timing. Liquid not ejected from the first nozzle orifice 57*a*1 is allowed to flow into the first return manifold 52*a*1 belonging to the second island portion 300*b* via the first return narrowed portion 54*a*1. Some remaining liquid in the second supply manifold 51*b* that has not flowed into a second individual channel 60*b* is allowed to flow into the first return manifold 52*a*1 via the fifth bypass path 74. Liquid in the first return manifold 52*a*1 is then returned to a corresponding tank 16 via a second outlet 59*b*.

In the first island portion 300*a*, the first supply manifold 51*a* is in fluid communication with a first pressure chamber 50*a*2 of another first individual channel 60*a* via a first supply narrowed portion 53*a*2. The first pressure chamber 50*a*2 is in fluid communication with one end of a first descender 56*a*2. The first descender 56*a*2 has a first nozzle orifice 57*a*2 at the other end thereof. Liquid is allowed to flow into the first pressure chamber 50*a*2 from the first supply manifold 51*a* via the first supply narrowed portion 53*a*2 and to be ejected in droplet form from the first nozzle orifice 57*a*2 at a certain timing. Liquid not ejected from the first nozzle orifice 57*a*2 is allowed to flow into the first return manifold 52*a*2 belonging to the third island portion 300*c* via the first return narrowed portion 54*a*2. Some remaining liquid in the third supply manifold 51*c* that has not flowed into a third individual channel 60*c* is allowed to flow into the first return manifold 52*a*2 via the sixth bypass path 75. Liquid in the first return manifold 52*a*2 is then returned to a corresponding tank 16 via a third outlet.

In the second island portion 300*b*, the second supply manifold 51*b* is in fluid communication with a second pressure chamber 50*b* of a second individual channel 60*b* via a second supply narrowed portion 53*b*. The second pressure chamber 50*b* is in fluid communication with one end of a second descender 56*b*. The second descender 56*b* has a second nozzle orifice 57*b* at the other end thereof. Liquid is allowed to flow into the second pressure chamber 50*b* from the second supply manifold 51*b* via the second supply narrowed portion 53*b* and to be ejected in droplet form from the second nozzle orifice 57*b* at a certain timing. Liquid not ejected from the second nozzle orifice 57*b* is allowed to flow into the second return manifold 52*b* belonging to the first island portion 300*a* via the second return narrowed portion 54*b*.

Liquid is allowed to flow into the second return manifold 52*b* also from the third island portion 300*c* as described below. In the third island portion 300*c*, the third supply manifold 51*c* is in fluid communication with a third pressure chamber 50*c* of a third individual channel 60*c* via a third supply narrowed portion 53*c*. The third pressure chamber 50*c* is in fluid communication with one end of a third descender 56*c*. The third descender 56*c* has a third nozzle orifice 57*c* at the other end thereof. Liquid is allowed to flow into the third pressure chamber 50*c* from the third supply manifold 51*c* via the third supply narrowed portion 53*c* and to be ejected in droplet form from the third nozzle orifice 57*c* at a certain timing. Liquid not ejected from the third nozzle orifice 57*c* is allowed to flow into the second return manifold 52*b* belonging to the first island portion 300*a* via the third return narrowed portion 54*c*.

Some remaining liquid in the first supply manifold 51*a* that has not flowed into the first individual channel 60*a* is allowed to flow into the second return manifold 52*b* via the first bypass path 70. Liquid in the second return manifold 52*b* is then returned to a corresponding tank 16 via a first outlet 59*a*.

According to one or more aspects of the disclosure, a head module may include a plurality of first individual channels 60*a*, a first supply manifold 51*a*, a first return manifold 52*a*, a plurality of second individual channels 60*b*, a second supply manifold 51*b*, a second return manifold 52*b*, and a first bypass path 70. The first individual channels 60*a* may each include a first nozzle orifice 57*a*. The first supply manifold 51*a* may be in fluid communication with the first individual channels 60*a* and configured to allow liquid to flow into the first individual channels 60*a* therefrom. The first return manifold 52*a* may be in fluid communication with the first individual channels 60*a* and configured to allow liquid not ejected from the first nozzle orifices 57*a* to flow thereinto. The second individual channels 60*b* may each include a second nozzle orifice 57*b*. The second supply manifold 51*b* may be in fluid communication with the second individual channels 60*b* and configured to allow liquid to flow into the second individual channels 60*b* therefrom. The second return manifold 52*b* may be in fluid communication with the second individual channels 60*b* and configured to allow liquid not ejected from the second nozzle orifices 57*b* to flow thereinto. The first bypass path 70 may provide fluid communication between the first supply manifold 51*a* and the second return manifold 52*b*.

According to the above configuration, effect of crosstalk caused by pressure wave propagation may be reduced.

According to one or more aspects of the disclosure, in the head module having the above configuration, the head module may have a nozzle surface in which the first nozzle orifices 57*a* and the second nozzle orifices 57*b* may be defined. The first bypass path 70 may include a first bypass hole 70*a* and a first flow path 70*b*. The first bypass path 70 may be in fluid communication with the second return manifold 52*b*. The first flow path 70*b* may overlap the first supply manifold 51*a* and the first bypass hole 70*a* when viewed in plan from the nozzle surface. The first flow path 70*b* may provide fluid communication between the first supply manifold 51*a* and the first bypass hole 70*a*.

According to the above configuration, the first bypass path 70 may include the first flow path 70*b* and the first bypass hole 70*a*. Thus, pressure to be applied to liquid flowing through the first bypass path 70 may be easily controlled by changing the shapes and sizes of the first flow path 70*b* and the first bypass hole 70*a* as appropriate.

According to one or more aspects of the disclosure, in the head module having the above configuration, when it is assumed that a direction toward which the nozzle surface faces is defined as a down direction and a direction opposite to the down direction is defined as an up direction, the first supply manifold 51*a* may be disposed above the first return manifold 52*a* and the second supply manifold 51*b* may be disposed above the second return manifold 52*b*. The first flow path 70*b* may include a groove defined in a wall defining the first supply manifold 51*a* and the second return manifold 52*b*. The groove may extend from the first supply manifold 51*a* toward the second return manifold 52*b*. The first bypass hole 70*a* may extend in an up-down direction in the wall.

According to the above configuration, the first flow path 70*b* may be a groove. Thus, when viewed in plan from the nozzle surface, liquid may be allowed to flow between the first supply manifold 51*a* and the second return manifold 52*b* in a case where the first supply manifold 51*a* and the second return manifold 52*b* are apart from each other. Thus, versatility of arrangement of the first supply manifold 51*a* and the second return manifold 52*b* may be increased. Further, pressure to be applied to liquid flowing through the first bypass path 70 may be easily controlled by changing the shape and size of the groove.

According to one or more aspects of the disclosure, in the head module having the above configuration, when it is assumed that a direction toward which the nozzle surface faces is defined as a down direction and a direction opposite to the down direction is defined as an up direction, the first supply manifold 51*a* may be disposed above the first return manifold 52*a* and the second supply manifold 51*b* may be disposed above the second return manifold 52*b*. The first flow path 70*b* may include a hole defined in a wall defining the first supply manifold 51*a* and the second return manifold 52*b*. The hole may extend in an up-down direction. The first bypass hole 70*a* may have a smaller diameter than the first flow path 70*b* and extend in the up-down direction in the wall.

According to the above configuration, the first flow path 70*b* and the first bypass hole 70*a* may be holes extending in the wall in the up-down direction. Thus, pressure to be applied to liquid flowing through the first bypass path 70 may be easily controlled by changing the shapes and sizes of the holes. The wall may include a first damper plate 80 and a second damper plate 81. The first damper plate 80 may have the first flow path 70*b* and the second damper plate 81 may have the first bypass hole 70*a*. In some cases, the first damper plate 80 and the second damper plate 81 may be laminated with being misaligned relative to each other. Even if such a situation happens, as the first bypass hole 70*a* has a diameter smaller than the first flow path 70*b*, liquid may be allowed to flow into the second return manifold 52*b* from the first supply manifold 51*a* under at least a certain pressure controlled by the diameter of the first bypass hole 70*a*.

According to one or more aspects of the disclosure, in the head module having the above configuration, when viewed in plan from the nozzle surface, the first supply manifold 51*a* and the first return manifold 52*a* may overlap each other and extend in the same extending direction. The first supply manifold 51*a* and the first return manifold 52*a* may have respective different lengths in the extending direction.

According to the above configuration, the first supply manifold 51*a* and the first return manifold 52*a* may have the respective different lengths in the extending direction. With this configuration, the first bypass path 70 that may be in fluid communication with the first supply manifold 51*a* and another bypass path (e.g., the second bypass path 71) that may be in fluid communication with the first return manifold 52*a* may be positioned at respective different positions without overlapping each other.

According to one or more aspects of the disclosure, in the head module having the above configuration, when viewed in plan from the nozzle surface, the center of the first bypass hole 70*a* may be on a center line O between and parallel to the first supply manifold 51*a* and the second return manifold 52*b*.

According to the above configuration, when viewed in plan from the nozzle surface, the center of the first bypass hole 70*a* of the first bypass path 70 may be on the center line O between and parallel to the first supply manifold 51*a* and the second return manifold 52*b*, both of which extend in the same extending direction. Thus, when the first supply manifold 51*a* and the second return manifold 52*b* are viewed in plan, i.e., when viewed in plan from the nozzle surface, a combined shape of the first supply manifold 51*a* and the first bypass path 70 and the shape of the second return manifold 52*b* may be substantially symmetric with respect to the center line O. Such a configuration may thus enable a smooth connection of the first supply manifold 51*a* and the second return manifold 52*b*. It is assumed that, when viewed in plan from the nozzle surface, the front end portion of one of the first supply manifold 51*a* and the second return manifold 52*b* extends straightly in the extending direction. In such a case, the front end portion of the other of the first supply manifold 51*a* and the second return manifold 52*b* may need to be bent to connect between the first supply manifold 51*a* and the second return manifold 52*b*. Thus, the front portion of the other manifold bending toward the one manifold may be curved sharply to connect to the front end portion of the one manifold. Nevertheless, according to one or more aspects of the disclosure, the center of the first bypass hole 70*a* of the first bypass path 70 may be on the center line O. Thus, the first supply manifold 51*a* and the second return manifold 52*b* may extend so as to approach each other and the first supply manifold 51*a* and the second return manifold 52*b* may be connected to each other with both front end portions being curved gently.

According to one or more aspects of the disclosure, the head module above configuration may further include a second bypass path 71 providing fluid communication between the second supply manifold 51*b* and the first return manifold 52*a*. The head module may have a nozzle surface in which the first nozzle orifices 57*a* and the second nozzle orifices 57*b* may be defined. In such a head module, the second bypass path 71 may include a second bypass hole 71*a* and a second flow path 71*b*. The second bypass path 71 may be in fluid communication with the first return manifold 52*a*. The second flow path 71*b* may overlap the second supply manifold 51*b* and the second bypass hole 71*a* when viewed in plan from the nozzle surface. The second flow path 71*b* may provide fluid communication between the second supply manifold 51*b* and the second bypass hole 71*a*.

According to the above configuration, the head module may further include the second bypass path 71 that may provide fluid communication between the second supply manifold 51*b* and the first return manifold 52*a*. Such a configuration may thus provide fluid communication between the first supply manifold 51*a* and the second return manifold 52*b* and between the second supply manifold 51*b* and the first return manifold 52*a*.

With this configuration, a pressure wave propagating through the first supply manifold 51*a* may further propagate to the second return manifold 52*b*, thereby reducing or preventing occurrence of crosstalk that may be caused by merging of a pressure wave propagating through the first supply manifold 51*a* and a pressure wave propagating through the first return manifold 52*a* having the same phase as the former pressure wave. Further, a pressure wave propagating through the second supply manifold 51*b* may further propagate to the first return manifold 52*a*, thereby reducing or preventing occurrence of crosstalk that may be caused by merging of a pressure wave propagating through the second supply manifold 51*b* and a pressure wave propagating through the second return manifold 52*b* having the same phase as the former pressure wave.

In addition, the second flow path 71 may include the second flow path 71*b* and the second bypass hole 71*a*. Thus, pressure to be applied to liquid flowing through the second bypass path 71 may be easily controlled by changing the shapes and sizes of the second flow path 71*b* and the second bypass hole 71*a* as appropriate.

According to one or more aspects of the disclosure, in the head module above configuration, the first supply manifold 51*a* may have one end portion having a first inlet 58*a* allowing liquid to flow into the first supply manifold 51*a* and the other end portion connecting to the first bypass path 70. The first return manifold 52*a* may have one end portion having a first outlet 59*a* allowing liquid to flow out of the first return manifold 52*a* and the other end portion connecting to the second bypass path 71. The second supply manifold 51*b* may have one end portion having a second inlet 58*b* allowing liquid to flow into the second supply manifold 51*b* and the other end portion connecting to the second bypass path 71. The second return manifold 52*b* may have one end portion having a second outlet 59*b* allowing liquid to flow out of the second supply manifold 51*b* and the other end portion connecting to the first bypass path 70. The first bypass path 70 may include a first bypass hole 70*a* being in fluid communication with the second return manifold 52*b*. In such a head module, a distance $R_1$ from the center of the first inlet 58*a* to the center of the first bypass hole 70*a* may be equal to a distance $R_2$ from the center of the second outlet 59*b* to the center of the first bypass hole 70*a*. A distance $r_1$ from the center of the second inlet 58*b* to the center of the second bypass hole 71*a* may be equal to a distance $r_2$ from the center of the first outlet 59*a* to the center of the second bypass hole 71*a*.

According to the above configuration, resistance to be applied to liquid flowing in the channels during manifold circulation may be equalized. Thus, an equal pressure may be applied to both of the first nozzle orifice 57*a* that may be one of the constituents of the first individual channel 60*a* and the second nozzle orifice 57*b* that may be one of the constituents of the second individual channel 60*b*. Consequently, such a configuration may reduce occurrences of meniscus breaks and variations in a meniscus shape due to locations, thereby reducing liquid ejection variations.

According to one or more aspects of the disclosure, in the head module above configuration, the first bypass path 70 and the second bypass path 71 may be positioned such that the center of the first bypass hole 70*a* and the center of the second bypass hole 71*a* may be apart from each other in a direction perpendicular to the extending direction.

In view of prevention of liquid leakage, the first bypass path 70 and the second bypass path 71 may need to be apart from each other by a certain distance. In a case where the center of the first bypass hole 70*a* and the center of the second bypass hole 71*a* are aligned with each other in the extending direction, the first bypass hole 70*a* and the second bypass hole 71*a* may need to be apart from each other in the extending direction to ensure that the first bypass path 70 and the second bypass path 71 are apart from each other by the certain distance. Such a configuration may however cause increase of the size of the manifolds in the extending direction in the head module.

Nevertheless, according to one or more aspects of the disclosure, the first bypass path 70 and the second bypass path 71 may be positioned such that the center of the first bypass hole 70*a* and the center of the second bypass hole 71*a* may be apart from each other in the direction perpendicular to the extending direction. Thus, the first bypass hole 70*a* and the second bypass hole 71*a* might not necessarily be apart from each other by a certain distance in the extending direction, thereby reducing the size of the head module.

According to one or more aspects of the disclosure, in the head module having the above configuration, when viewed in plan from the nozzle surface, the first supply manifold 51*a* and the second return manifold 52*b* that may be in fluid communication with each other via the first bypass path 70 may be disposed next to each other.

According to the above configuration, when viewed in plan from the nozzle surface, the first supply manifold 51*a* and the second return manifold 52*b* that may be in fluid communication with each other via the first bypass path 70 may be disposed next to each other. Such an arrangement may thus enable the first bypass path 70 to have a minimum length, thereby easily connecting between the first supply manifold 51*a* and the second return manifold 52*b* for fluid communication.

The first supply manifold 51*a* and the second return manifold 52*b* being disposed next to each other when viewed in plan from the nozzle surface may refer to that the first supply manifold 51*a* and the second return manifold 52*b* are positioned such that the distance therebetween is shortest and no other manifold is positioned therebetween.

According to one or more aspects of the disclosure, the head module above configuration may further include a first island portion 300*a* to which the first individual channels 60*a* belong, and a second island portion 300*b* disposed next to the first island portion 300*a* and to which the second individual channels 60*b* belong. In such a head module, the first supply manifold 51*a* may belong to the first island portion 300*a* and the first return manifold 52*a* may belong to the second island portion 300*b*.

According to the above configuration, the first individual channel 60*a* belonging to the first island portion 300*a* may be in fluid communication with the first supply manifold 51*a* belonging to the same first island portion 300*a* and also in fluid communication with the first return manifold 52*a* belonging to the second island portion 300*b* located next to the first island portion 300*a*. As compared with a configuration in which both of the first supply manifold 51*a* and the first return manifold 52*a* belong to the same first island portion 300*a*, the above configuration according to the one or more disclosure may enable a return narrowed portion that may connect between the first individual channel 60*a* and the first return manifold 52*a* to be longer, thereby applying a desired level of resistance to liquid flowing through the return narrowed portion.

According to one or more aspects of the disclosure, in the head module having the above configuration, the second supply manifold 51*b* may belong to the second island portion 300*b*, and the second return manifold 52*b* may belong to the first island portion 300*a*. Each of the first individual channels 60*a* may include a first return narrowed portion 54*a* that may be a flow path being in fluid communication with the first return manifold 52*a* belonging to the second island portion 300*b*. Each of the second individual channels 60*b* may include a second return narrowed portion 54*b* that may be a flow path being in fluid communication with the second return manifold 52*b* belonging to the first island portion 300*a*.

According to the above configuration, the adjacent two island portions may be connected to each other via the first return narrowed portion 54*a* and the second return narrowed portion 54*b*. Consequently, such a configuration may decrease the required number of individual channels and may enable the individual channels to be arranged at highly populated density as compared with a case where the first individual channel 60*a* belonging to the first island portion 300*a* is in fluid communication with the first return manifold 52*a* via the first return narrowed portion 54*a* and the second individual channel 60*b* belonging to the second island portion 300*b* is in fluid communication with the second return manifold 52*b* belonging to another island portion different from the first island portion 300*a* via the second return narrowed portion 54*b*.

According to one or more aspects of the disclosure, in the head module having the above configuration, the first supply manifold 51*a* may have a first inlet 58*a* allowing liquid to flow into the first supply manifold 51*a*, and the first return manifold 52*a* may have a first outlet 59*a* allowing liquid to flow out of the first return manifold 52*a*. Each of the first individual channels 60*a* may include a first supply narrowed portion 53*a* and a first return narrowed portion 54*a*. The first supply narrowed portion 53*a* may be a flow path being in fluid communication with the first supply manifold 51*a* via a first connecting portion 40. The first return narrowed portion 54*a* may be a flow path being in fluid communication with the first return manifold 52*a* via a second connecting portion 41. In such a head module, a distance $\beta$ from the center of the first outlet 59*a* to the second connecting portion 41 may be equal to a distance $\alpha$ from the center of the first inlet 58*a* to the first connecting portion 40.

Note that the first supply manifold 51*a* may be at a positive pressure and the first return manifold 52*a* may be at a negative pressure.

According to the above configuration, the distance $\beta$ from the center of the first outlet 59*a* to the second connecting portion 41 may be equal to the distance $\alpha$ from the center of the first inlet 58*a* to the first connecting portion 40. Such a configuration may thus easily control pressure to be applied to liquid at the first nozzle orifice 57*a* of the first individual channel 60*a*.

According to one or more aspects of the disclosure, in the head module having the above configuration, the first individual channels 60*a* belonging to the first island portion 300*a* may be arranged in a row and the second individual channels 60*b* belonging to the second island portion 300*b* may be arranged in a row in the same direction as the direction in which the first individual channels 60*a* may be arranged. In such a head module, the second connecting portion 41 may be disposed between adjacent second individual channels 60*b* in the second island portion 300*b*.

According to the above configuration, the second connecting portion 41 may be disposed between adjacent second individual channels 60*b* belonging to the second island portion 300*b*. With this arrangement, the first return narrowed portion 54*a* might not obstruct the arrangement of the second individual channels 60*b* in the second island portion 300*b*.

According to one or more aspects of the disclosure, the head module having the above configuration may further include a plurality of third individual channels 60*c*, a third supply manifold 51*c*, a third return manifold 52*c*, a third bypass path 72, and a fourth bypass path 73. The third individual channels 60*c* may each include a third nozzle orifice 57*c*. The third supply manifold 51*c* may be in fluid communication with the third individual channels 60*c* and configured to allow liquid to flow into the third individual channels 60*c*. The third return manifold 52*c* may be in fluid communication with the third individual channels 60*c* and configured to allow liquid not ejected from the third nozzle orifices 57*c* to flow thereinto. The third bypass path 72 may provide fluid communication between the second supply manifold 51*b* and the third return manifold 52*c*. The fourth bypass path 73 may provide fluid communication between the third supply manifold 51*c* and the first return manifold 52*a*. In such a head module, a circulation route may be defined in which liquid flows through at least one of the first individual channels 60*a*, at least one of the second individual channels 60*b*, and at least one of the third individual channels 60*c*.

According to the above configuration, the head module may implement the nozzle circulation and the manifold circulation between three individual channels (e.g., between the first individual channel 60*a*, the second individual channel 60*b*, and the third individual channel 60*c*), and reduce effect of crosstalk caused by pressure wave propagation.

The above configurations may implement the nozzle circulation and the manifold circulation. In order to reduce effect of crosstalk caused by pressure wave propagation, in one example, a bypass path may connect between a supply manifold and a return manifold that may belong to respective different island portions, and in another example, return narrowed portions may belong to respective different island portions. Nevertheless, in other embodiments, for example, a bypass path may connect between particular island portions and a return narrowed portion may connect between other particular island portions.

According to one or more aspects of the disclosure, another head module may include a plurality of first individual channels 60*a*, a first supply manifold 51*a*, a first return manifold 52*a*, a plurality of second individual channels 60*b*, a second supply manifold 51*b*, a second return manifold 52*b*, a plurality of third individual channels 60*c*, a first island portion 300*a*, a second island portion 300*b*, and a third island portion 300*c*. The first individual channels 60*a* may each include a first nozzle orifice 57*a*. The first supply manifold 51*a* may be in fluid communication with the first individual channels 60*a* and configured to allow liquid to flow into the first individual channels 60*a* therefrom. The first return manifold 52*a* may be in fluid communication with the first individual channels 60*a* and configured to allow liquid not ejected from the first nozzle orifices 57*a* to flow thereinto. The second individual channels 60*b* may each include a second nozzle orifice 57*b*. The second supply manifold 51*b* may be in fluid communication with the second individual channels 60*b* and configured to allow liquid to flow into the second individual channels 60*b* therefrom. The second return manifold 52*b* may be in fluid communication with the second individual channels 60*b* and configured to allow liquid not ejected from the second nozzle orifices 57*b* to flow thereinto. The third individual channels 60*c* may each include a third nozzle orifice 57*c*. The first island portion to which the first individual channels 60*a* may belong to the first island portion 300*a*. The second island portion 300*b* may be disposed next to the first island portion 300*a*. The second individual channels 60*b* may belong to the second island portion 300*b*. The third island portion 300*c* may be disposed next to the second island portion 300*b*. The third individual channels 60*c* may belong to the third island portion 300*c*.

In such a head module, the first supply manifold 51*a* may belong to the first island portion 300*a* and the first return manifold 52*a* may belong to the second island portion 300*b*. The second supply manifold 51*b* may belong to the second island portion 300*b* and the second return manifold 52*b* may belong to the third island portion 300*c*. Each of the first individual channels 60*a* may include a first return narrowed portion 54*a* that may be a flow path being in fluid communication with the first return manifold 52*a* belonging to the second island portion 300*b*. Each of the second individual channels 60*b* may include a second return narrowed portion 54*b* that may be a flow path being in communication with the second return manifold 52*b* belonging to the third island portion 300*c*.

According to the above configuration, the first island portion 300*a* and the second island portion 300*b* may be connected to each other via the first return narrowed portion 54*a*, and the second island portion 300*b* and the third island portion 300*c* may be connected to each other via the second return narrowed portion 54*b*.

Such a configuration may thus enable the head module to have more individual channels than a head module in which adjacent two island portions are connected to each other via a first return narrowed portion and a second return narrowed portion. The first island portion 300*a* and the second island portion 300*b* may be connected to each other via at least one of the first return narrowed portion 54*a* or the second return narrowed portion 54*b*. Thus, less areas may be required for the return narrowed portions.

In order to reduce effect of a pressure wave propagating through the supply manifold and a pressure wave propagating through the return manifold in each island portion, a damper portion may be provided between the supply manifold and the return manifold. Such a configuration may increase the number of individual channels and require less areas for the return narrowed portions connecting between the first island portion 300*a* and the second island portion 300*b*, thereby ensuring large areas for damper portions to improve the damper performance.

The disclosure may be applied to, for example, an inkjet printer that may eject liquid droplets onto a sheet from nozzles.

What is claimed is:

1. A head module comprising:

a plurality of first individual channels each including a first nozzle orifice;

a first supply manifold being in fluid communication with the first individual channels and configured to allow liquid to flow into the first individual channels therefrom;

a first return manifold being in fluid communication with the first individual channels and configured to allow liquid not ejected from the first nozzle orifices to flow thereinto;

a plurality of second individual channels each including a second nozzle orifice;

a second supply manifold being in fluid communication with the second individual channels and configured to allow liquid to flow into the second individual channels therefrom;

a second return manifold being in fluid communication with the second individual channels and configured to allow liquid not ejected from the second nozzle orifices to flow thereinto; and a first bypass path providing fluid communication between the first supply manifold and the second return manifold.

2. The head module according to claim 1, wherein the head module has a nozzle surface in which the first nozzle orifices and the second nozzle orifices are defined, and wherein the first bypass path includes:

a first bypass hole being in fluid communication with the second return manifold; and a first flow path overlapping the first supply manifold and the first bypass hole when viewed in plan from the nozzle surface, and providing fluid communication between the first supply manifold and the first bypass hole.

3. The head module according to claim 2, wherein, when it is assumed that a direction toward which the nozzle surface faces is defined as a down direction and a direction opposite to the down direction is defined as an up direction, the first supply manifold is disposed above the first return manifold and the second supply manifold is disposed above the second return manifold, wherein the first flow path includes a groove defined in a wall defining the first supply manifold and the second return manifold, wherein the groove extends from the first supply manifold toward the second return manifold, and wherein the first bypass hole extends in an up-down direction in the wall.

4. The head module according to claim 2, wherein, when it is assumed that a direction toward which the nozzle surface faces is defined as a down direction and a direction opposite to the down direction is defined as an up direction, the first supply manifold is disposed above the first return manifold and the second supply manifold is disposed above the second return manifold, wherein the first flow path includes a hole defined in a wall defining the first supply manifold and the second return manifold, wherein the hole extends in an up-down direction, and wherein the first bypass hole has a smaller diameter than the first flow path and extends in the up-down direction in the wall.

5. The head module according to claim 2, wherein when viewed in plan from the nozzle surface, the first supply manifold and the first return manifold overlap each other and extend in a same extending direction, and wherein the first supply manifold and the first return manifold have different respective lengths in the extending direction.

6. The head module according to claim 5, wherein when viewed in plan from the nozzle surface, the center of the first bypass hole is on a center line between and parallel to the first supply manifold and the second return manifold.

7. The head module according to claim 1, further comprising a second bypass path providing fluid communication between the second supply manifold and the first return manifold, wherein the head module has a nozzle surface in which the first nozzle orifices and the second nozzle orifices are defined, and wherein the second bypass path includes:

a second bypass hole in fluid communication with the first return manifold; and a second flow path overlapping the second supply manifold and the second bypass hole when viewed in plan from the nozzle surface, and providing fluid communication between the second supply manifold and the second bypass hole.

8. The head module according to claim 7, wherein the first supply manifold has one end portion having a first inlet allowing liquid to flow into the first supply manifold and the other end portion connecting to the first bypass path, wherein the first return manifold has one end portion having a first outlet allowing liquid to flow out of the first return manifold and the other end portion connecting to the second bypass path, wherein the second supply manifold has one end portion having a second inlet allowing liquid to flow into the second supply manifold and the other end portion connecting to the second bypass path, wherein the second return manifold has one end portion having a second outlet allowing liquid to flow out of the second supply manifold and the other end portion connecting to the first bypass path, wherein the first bypass path includes a first bypass hole being in fluid communication with the second return manifold, wherein a distance from the center of the first inlet to the center of the first bypass hole is equal to a distance from the center of the second outlet to the center of the first bypass hole, and wherein a distance from the center of the second inlet to the center of the second bypass hole is equal to a distance from the center of the first outlet to the center of the second bypass hole.

9. The head module according to claim 8, wherein when viewed in plan from the nozzle surface, the first supply manifold and the first return manifold overlap each other and the second supply manifold and the second return manifold overlap each other, wherein the first supply manifold, the first return manifold, the second supply manifold, and the second return manifold extend in a same extending direction, and wherein the first bypass path and the second bypass path are positioned such that the center of the first bypass hole and the center of the second bypass hole are apart from each other in a direction perpendicular to the extending direction.

10. The head module according to claim 1, wherein when viewed in plan from a nozzle surface in which the first nozzle orifices and the second nozzle orifices are defined, the first supply manifold and the second return manifold that are in fluid communication with each other via the first bypass path are disposed next to each other.

11. The head module according to claim 1, further comprising:

a first island portion to which the first individual channels belong; and a second island portion disposed next to the first island portion and to which the second individual channels belong, wherein the first supply manifold belongs to the first island portion and the first return manifold belongs to the second island portion.

12. The head module according to claim 11, wherein the second supply manifold belongs to the second island portion, wherein the second return manifold belongs to the first island portion, wherein each of the first individual channels includes a first return narrowed portion that is a flow path being in fluid communication with the first return manifold belonging to the second island portion, and wherein each of the second individual channels includes a second return narrowed portion that is a flow path being in fluid communication with the second return manifold belonging to the first island portion.

13. The head module according to claim 11, wherein the first supply manifold has a first inlet allowing liquid to flow into the first supply manifold, wherein the first return manifold has a first outlet allowing liquid to flow out of the first return manifold, wherein each of the first individual channels includes:

a first supply narrowed portion that is a flow path being in fluid communication with the first supply manifold via a first connecting portion, a first return narrowed portion that is a flow path being in fluid communication with the first return manifold via a second connecting portion, and wherein a distance from the center of the first outlet to the second connecting portion is equal to a distance from the center of the first inlet to the first connecting portion.

14. The head module according to claim 13, wherein the first individual channels belonging to the first island portion are arranged in a row and the second individual channels belonging to the second island portion are arranged in a row in a same direction as a direction in which the first individual channels are arranged, and wherein the second connecting portion is disposed between adjacent second individual channels in the second island portion.

15. The head module according to claim 1, further comprising:

a plurality of third individual channels;

a third supply manifold being in fluid communication with the third individual channels and configured to allow liquid to flow into the third individual channels;

a third return manifold being in fluid communication with the third individual channels and configured to allow liquid not ejected from third nozzle orifices to flow thereinto;

a third bypass path providing fluid communication between the second supply manifold and the third return manifold; and a fourth bypass path providing fluid communication between the third supply manifold and the first return manifold, wherein a circulation route is defined in which liquid flows through at least one of the first individual channels, at least one of the second individual channels, and at least one of the third individual channels.

16. A head module, comprising:

a plurality of first individual channels each including a first nozzle orifice;

a first supply manifold being in fluid communication with the first individual channels and configured to allow liquid to flow into the first individual channels therefrom;

a first return manifold being in fluid communication with the first individual channels and configured to allow liquid not ejected from the first nozzle orifices to flow thereinto;

a plurality of second individual channels each including a second nozzle orifice;

a second supply manifold being in fluid communication with the second individual channels and configured to allow liquid to flow into the second individual channels therefrom;

a second return manifold being in fluid communication with the second individual channels and configured to allow liquid not ejected from the second nozzle orifices to flow thereinto;

a plurality of third individual channels each including a third nozzle orifice;

a first island portion to which the first individual channels belong;

a second island portion disposed next to the first island portion and to which the second individual channels belong; and a third island portion disposed next to the second island portion and to which the third individual channels belong, wherein the first supply manifold belongs to the first island portion and the first return manifold belongs to the second island portion, wherein the second supply manifold belongs to the second island portion and the second return manifold belongs to the third island portion, wherein each of the first individual channels includes a first return narrowed portion that is a flow path being in fluid communication with the first return manifold belonging to the second island portion, and wherein each of the second individual channels includes a second return narrowed portion that is a flow path being in communication with the second return manifold belonging to the third island portion.

* * * * *